US008070262B2

(12) United States Patent
Yamaguchi et al.

(10) Patent No.: US 8,070,262 B2
(45) Date of Patent: Dec. 6, 2011

(54) PRINT ELEMENT SUBSTRATE, PRINTHEAD, AND PRINTING APPARATUS

(75) Inventors: Takaaki Yamaguchi, Yokohama (JP); Yoshiyuki Imanaka, Kawasaki (JP); Koichi Omata, Kawasaki (JP); Souta Takeuchi, Yokohama (JP); Kousuke Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 450 days.

(21) Appl. No.: 12/428,995

(22) Filed: Apr. 23, 2009

(65) Prior Publication Data

US 2009/0278890 A1 Nov. 12, 2009

(30) Foreign Application Priority Data

May 8, 2008 (JP) ..... 2008-122772

(51) Int. Cl.
*B41J 2/05* (2006.01)

(52) U.S. Cl. ..... 347/57; 347/13; 347/62; 347/40

(58) Field of Classification Search ..... 347/12, 347/13, 20, 40, 49, 50, 56–59, 61–65, 67
See application file for complete search history.

(56) References Cited

U.S. PATENT DOCUMENTS

| | | | | |
|---|---|---|---|---|
| 5,754,193 | A * | 5/1998 | Elhatem | 347/12 |
| 5,754,201 | A | 5/1998 | Ishinaga et al. | |
| 6,137,502 | A | 10/2000 | Anderson et al. | |
| 6,409,315 | B2 | 6/2002 | Komuro | |
| 6,431,685 | B1 * | 8/2002 | Misumi | 347/57 |
| 6,474,790 | B2 | 11/2002 | Kaneko | |
| 6,966,629 | B2 | 11/2005 | Nakajima et al. | |
| 7,309,120 | B2 | 12/2007 | Hatsui et al. | |
| 7,819,493 | B2 | 10/2010 | Hirayama et al. | |
| 2002/0089565 | A1 | 7/2002 | Lopez et al. | |
| 2002/0118241 | A1 | 8/2002 | Fujii | |
| 2006/0238558 | A1 | 10/2006 | Hatasa et al. | |
| 2007/0091131 | A1 | 4/2007 | Hatsui et al. | |
| 2007/0165055 | A1 | 7/2007 | Hirayama et al. | |
| 2007/0296745 | A1 | 12/2007 | Kasai et al. | |
| 2008/0100649 | A1 | 5/2008 | Matsui et al. | |
| 2008/0111864 | A1 | 5/2008 | Yamaguchi et al. | |
| 2011/0012950 | A1 | 1/2011 | Hirayama et al. | |

FOREIGN PATENT DOCUMENTS

| | | | |
|---|---|---|---|
| CN | 1163828 | A | 11/1997 |
| EP | 1543972 | A1 | 6/2005 |
| JP | 2002-374163 | A | 12/2002 |
| TW | I249472 | B | 2/2006 |
| TW | I253402 | B | 4/2006 |

* cited by examiner

*Primary Examiner* — Juanita D Stephens
(74) *Attorney, Agent, or Firm* — Fitzpatrick, Cella, Harper & Scinto

(57) ABSTRACT

This invention is directed to allow efficiently transferring data to each print element (heater) and efficiently laying out circuits in an element substrate including plural heater arrays in which different numbers of heaters are arranged. This substrate includes: a first array having a relatively large number of heaters; and a second array which is equal in length to the first array and has a relatively small number of heaters. These arrays are juxtaposed. The substrate further includes plural shift registers equal in number to the heater arrays of the substrate. The shift registers include a shift register which holds some data for driving the heaters of the first heater array, and data for driving the heaters of the second heater array. The shift registers further include a shift register which holds data other than some data for driving the heaters of the first heater array.

8 Claims, 15 Drawing Sheets

PRINT ELEMENT SUBSTRATE, PRINTHEAD, AND PRINTING APPARATUS

BACKGROUND OF THE INVENTION

1. Field of the Invention

The present invention relates to a print element substrate including a plurality of print element arrays in which different numbers of print elements are arrayed, a printhead, and a printing apparatus.

2. Description of the Related Art

A printhead which prints on a printing medium by discharging ink according to a thermal inkjet method includes, as print element building elements in the printhead, heaters formed from heat generation elements. Drivers for driving heaters, and logic circuits for selectively driving the drivers in accordance with print data are formed on a single element substrate of the printhead.

The resolution of thermal inkjet type color inkjet printing apparatuses is increasing year by year. Along with this, the orifice arrangement density of a printhead is set to discharge ink in the range of a resolution of 600 dpi to resolutions of 900 dpi and 1,200 dpi. There is known a printhead having orifices at such high density.

Demand has arisen for reducing graininess at a halftone portion or highlight portion in a gray image and color photo image. To meet this demand, the size of an ink droplet (liquid droplet) discharged to form an image was about 15 pl several years ago, but is recently decreasing to 5 pl and then 2 pl year after year in a printhead which discharges color ink.

A high-resolution printhead in which orifices for discharging small ink droplets are arranged at high density satisfies a user need for high-quality printing when printing a high-quality color graphic image or photo image. However, when not high-resolution printing but high-speed printing is required in, for example, printing a color graph in a spreadsheet, the above-mentioned printhead may not meet the demand for high-speed printing because printing with small ink droplets increases the number of print scan operations.

To achieve even high-speed printing, there has been proposed a printhead which discharges small ink droplets for high-quality printing and large ink droplets for high-speed printing. There have also been known a printhead in which a plurality of heaters are arranged for one orifice to change the discharge amount by these heaters, and a printhead in which a plurality of orifices having different discharge amounts are arranged in one element substrate.

Element substrates having a plurality of orifices for discharging different amounts of ink include an element substrate in which an orifice array (small-droplet orifice array) of orifices for discharging small ink droplets, and an orifice array (large-droplet orifice array) of orifices for discharging large ink droplets are juxtaposed. To achieve high-quality printing at high speed by this element substrate, there is proposed an element substrate in which the orifice arrangement density of a small-droplet orifice array is higher than that of a large-droplet orifice array. An example of this element substrate is one having a large-droplet orifice array in which 600 orifices are arranged per inch (arrangement density is 600 dpi), and a small-droplet orifice array in which 1,200 orifices double in number are arranged per inch (arrangement density is 1,200 dpi). Examples of this element substrate are arrangements disclosed in the U.S. Pat. Nos. 6,409,315, 6,474,790, 5,754,201, and 6,137,502, and Japanese Patent Laid-Open No. 2002-374163.

Recent inkjet printing apparatuses discharge small ink droplets to print a high-quality image. At the same time, these inkjet printing apparatuses need to increase the print speed. Simply forming the same image requires the same ink amount. Thus, if the discharged ink droplet is downsized to decrease the discharged ink amount to ½, the print speed simply decreases to ½.

To discharge the same ink amount in the same time in order to prevent a decrease in print speed, the number of heaters needs to be doubled. If the number of heaters is doubled without changing the heater arrangement density, the size of an element substrate in which heaters are arranged increases double or more. In addition to the increase in element substrate size, this also increases the size of the printhead which moves at high speed in the printing apparatus, the size of the printing apparatus, and vibrations and noise. To prevent these, the heater arrangement density needs to be increased.

To stably discharge ink, a stable voltage needs to be applied to heaters. When all heaters are driven concurrently, a large current flows, and the voltage greatly drops owing to the wiring resistance. To solve this, there is a time-divisional driving method of dividing a plurality of heaters on an element substrate into a plurality of blocks, and sequentially driving heaters for the respective blocks time-divisionally to stably discharge ink.

To print at high speed, a printhead having orifices for discharging large ink droplets is more advantageous than one having only orifices for discharging small ink droplets. Recent inkjet printing apparatuses adopt a printhead having an element substrate in which a small-droplet orifice array and large-droplet orifice array are juxtaposed. These inkjet printing apparatuses achieve both high-speed printing and high-quality printing by selectively driving orifices for discharging small ink droplets and those for discharging large ink droplets. However, to implement both high-speed printing and high-quality printing, the numbers of orifices and heaters integrated on the element substrate need to be increased.

There is also a method of increasing the frequency of a clock for transferring print data in order to print at high speed. In general, the clock is supplied from the printing apparatus main body to the printhead. The printhead which moves during printing, and the printing apparatus main body are connected by a relatively long cable such as a flexible cable. Since this cable contains plural signal lines and current supply lines, large currents flow close to each other through these lines in the cable. Thus, noise is readily superposed on signals transmitted through the cable. The inductance component of the cable delays the rise and fall of the pulse waveform (distorted waveform). This becomes non-negligible because, as the clock cycle shortens, the ratio of fluctuations becomes relatively high. The printhead may not be able to accurately receive a signal and may malfunction. When a signal is transmitted using a high-frequency clock, the cable may function as an antenna to generate radiation noise. The radiation noise may cause the malfunction of a peripheral device.

An element substrate including a large-droplet orifice array at an arrangement density of 600 dpi and a small-droplet orifice array with a double number of orifices at a double arrangement density of 1,200 dpi, which are arranged on a single substrate, will be exemplified. In this element substrate, when printing one pixel by one bit, the number of heaters directly equals the number of bits of print data. The data amount necessary for the orifice array at the arrangement density of 1,200 dpi is double the data amount necessary for the orifice array at the arrangement density of 600 dpi. The difference in data amount is directly related to the data transfer speed. Heaters in different arrays can be driven at individual driving frequencies as long as a clock signal is prepared for each print data corresponding to an orifice array.

Even when the time-divisional count and data amount differ between orifice arrays, data can be transferred within almost the same time. In a case where orifice arrays at arrangement densities of 600 dpi and 1,200 dpi coexist, data can be transferred within almost the same time by transferring data to the 1,200-dpi orifice array at double the speed of the 600-dpi orifice array.

However, preparing a clock signal for each print data corresponding to an orifice array increases the number of pads of the printhead and the number of signal lines between the printhead and the printing apparatus main body. As the numbers of pads and signal lines increase, the apparatus including the element substrate, printhead, and printing apparatus main body becomes bulky.

To prevent this, an element substrate which includes a plurality of orifice arrays at different arrayed densities and performs time-divisional driving employs the following arrangement. More specifically, a common clock signal CLK is employed, and the data transfer speed is set proportional to the number of data bits held in a shift register used for transfer. The numbers of data bits held in shift registers for high- and low-density orifice arrays differ from each other. The difference in the number of bits leads to a data transfer speed difference, limiting printing speed to the transfer speed for the high-density orifice array using a large number of bits. For example, assume that the number of bits in the shift register used for transfer is 7 bits (5 bits for print data and 2 bits for block control data) in a shift register corresponding to a 600-dpi orifice array, and 12 bits (10 bits for print data and 2 bits for block control data) in a shift register corresponding to a 1,200-dpi orifice array. Under this condition, even the data transfer speed of the 7-bit shift register complies with that of the 12-bit shift register. Hence, the 7-bit shift register transfers data at 7/12 of the original data transfer speed.

The area of the circuit pattern of the shift register corresponds to the number of bits. If the number of bits differs between a shift register corresponding to a high-density orifice array and that corresponding to a low-density orifice array, the area of the circuit pattern also differs between them, decreasing the circuit layout efficiency. The printhead also tends to be downsized, so it is necessary to lay out circuits more efficiently.

SUMMARY OF THE INVENTION

Accordingly, the present invention is conceived as a response to the above-described disadvantages of the conventional art.

For example, a print element substrate including a plurality of print element arrays in which different numbers of print elements are arranged according to this invention is capable of efficiently laying out circuits, and is capable of efficiently transferring data to each print element.

According to one aspect of the present invention, preferably, there is provided a print element substrate comprising: a first print element array and a second print element array each having a plurality of print elements; a first driving circuit which divides the plurality of print elements included in the first print element array into a predetermined number of groups and time-divisionally drives print elements belonging to each group; a second driving circuit which divides the plurality of print elements included in the second print element array into a larger number of groups than the predetermined number of groups, and time-divisionally drives print elements belonging to each group; a first shift register circuit which holds data for driving the print elements belonging to the first print element array, and data for driving part of the print elements belonging to the second print element array; and a second shift register circuit which holds data for driving part of the print elements belonging to the second print element array.

According to another aspect of the present invention, preferably, there is provided a printhead having the above print element substrate.

According to still another aspect of the present invention, preferably, there is provided a printing apparatus having a carriage capable of mounting the printhead.

The invention is particularly advantageous since data can be transferred to each print element efficiently and circuits can be laid out efficiently in an element substrate including a plurality of print element arrays in which different numbers of print elements are arranged.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, an element substrate (substrate for a printhead) in the description not only includes a simple substrate made of a silicon semiconductor, but also broadly includes an arrangement having elements, wires, and the like.

The expression "on a substrate" not only includes "on an element substrate", but also broadly includes "on the surface of an element substrate" and "inside of an element substrate near its surface". The term "built-in" in the invention not only includes "simply arrange separate elements on a substrate", but also broadly includes "integrally form and manufacture elements on an element substrate by a semiconductor circuit manufacturing process or the like".

<Inkjet Printing Apparatus>

Figure 9:
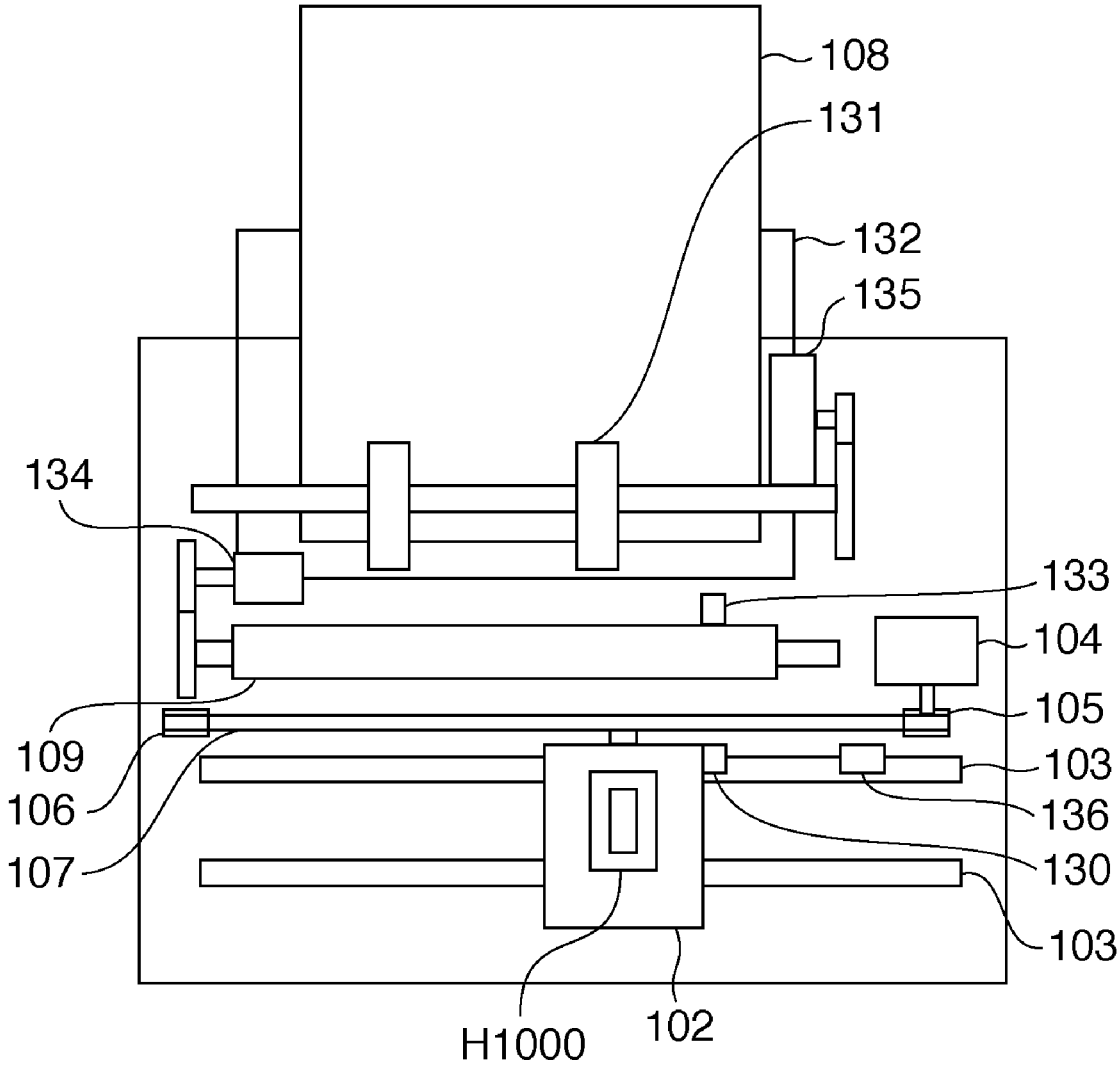
FIG. 9 is a schematic view showing an inkjet printing apparatus as an exemplary embodiment of the present invention.

A printing apparatus capable of mounting a printhead including an element substrate according to the present invention will be explained. FIG. 9 is a schematic view showing an example of an inkjet printing apparatus capable of mounting a printhead according to the present invention.

In the inkjet printing apparatus (to be also simply referred to as a printing apparatus hereinafter) shown in FIG. 9, a head cartridge H1000 is configured by combining a printhead including an element substrate according to the present invention, and a container which stores ink. The head cartridge H1000 is positioned and exchangeably mounted on a carriage 102. The carriage 102 includes an electrical connection for transmitting a driving signal and the like to each discharge portion via an external signal input terminal on the head cartridge H1000.

The carriage 102 is guided and supported reciprocally along guide shafts 103, which elongates in a main scanning direction, provided to the printing apparatus main body. A carriage motor 104 drives the carriage 102 via a driving mechanism including a motor pulley 105, associate pulley 106, and timing belt 107. Further, the carriage motor 104 controls the position and movement of the carriage 102.

An auto sheet feeder (ASF) 132 feeds printing media 108 separately one by one as a feed motor 135 rotates a pickup roller 131 via a gear. As a conveyance roller 109 rotates, the printing medium 108 is conveyed (sub-scanned) via a position (printing portion) facing the orifice surface of the head cartridge H1000. The conveyance roller 109 rotates via a gear as a conveyance motor 134 rotates. When the printing medium 108 passes through a paper end sensor 133, the paper end sensor 133 determines whether the printing medium 108 has been fed, and finalizes the start position upon paper feed.

A platen (not shown) supports the lower surface of the printing medium 108 to form a flat printing surface at the printing portion. In this case, the head cartridge H1000 mounted on the carriage 102 is held so that the orifice surface extends downward from the carriage 102 and becomes parallel to the printing medium 108 between the pair of two conveyance rollers.

The carriage 102 supports the head cartridge H1000 so that the orifice arrangement direction of the printhead coincides with a direction perpendicular to the scanning direction of the carriage 102. The head cartridge H1000 discharges liquid from orifice arrays to print.

<Control Arrangement>

A control arrangement for executing printing control of the above-described inkjet printing apparatus will be explained.

Figure 10:
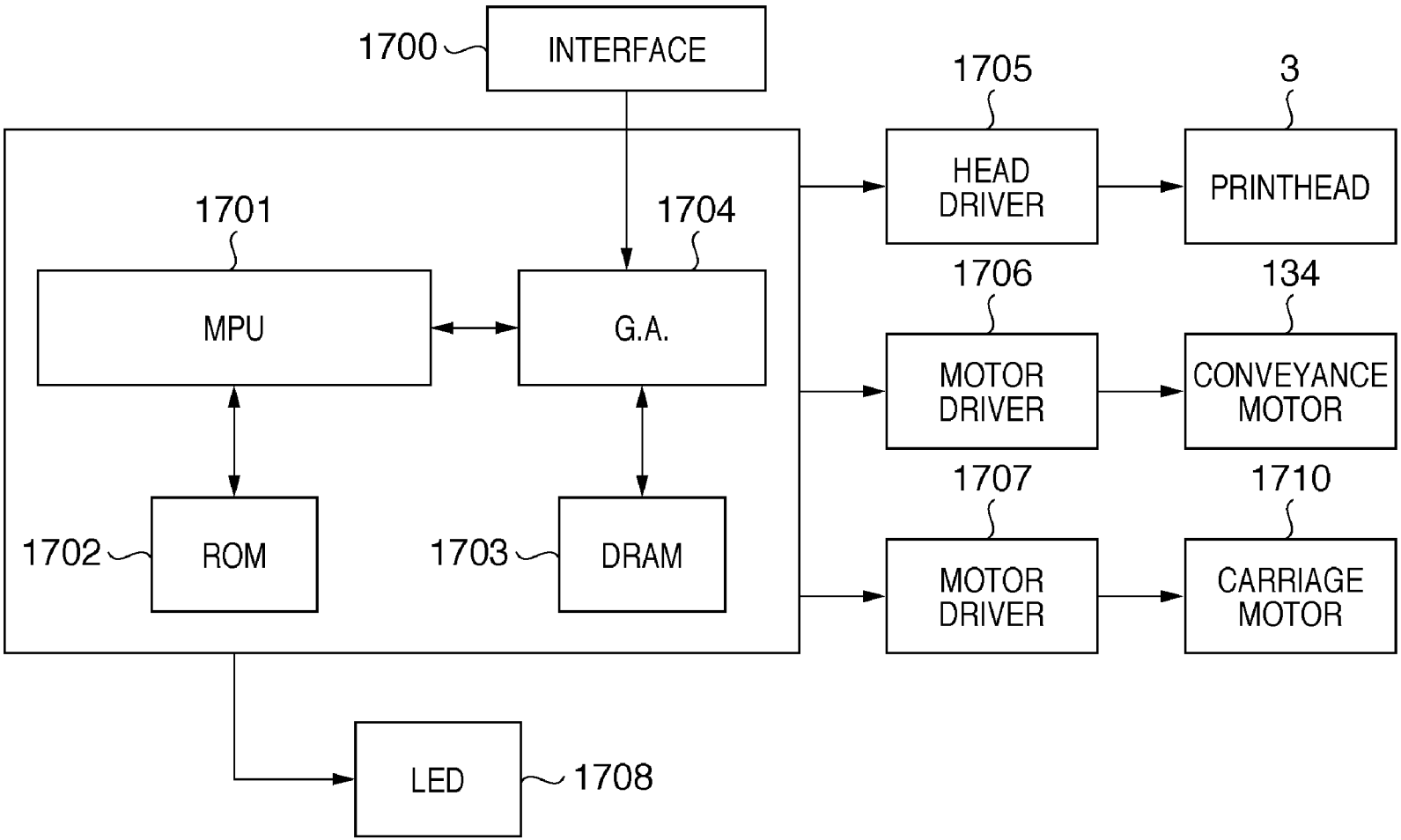
FIG. 10 is a block diagram showing the control arrangement of the inkjet printing apparatus shown in FIG. 9.

FIG. 10 is a block diagram showing the arrangement of the control circuit of the inkjet printing apparatus.

Referring to FIG. 10, an interface 1700 inputs a print signal. A ROM 1702 stores a control program to be executed by an MPU 1701. A DRAM 1703 saves various data (e.g., print data supplied to a printhead 3 of the head cartridge H1000). A gate array (G.A.) 1704 controls supply of print data to the printhead 3. The gate array 1704 also controls data transfer between the interface 1700, the MPU 1701, and the RAM 1703. A carriage motor 1710 conveys the head cartridge H1000 having the printhead 3. The conveyance motor 134 conveys a printing medium. A head driver 1705 drives the printhead 3, a motor driver 1706 drives the conveyance motor 134, and a motor driver 1707 drives the carriage motor 1710. For example, when the electrical connection is abnormal, an LED 1708 is turned on to notify this.

The operation of this control arrangement will be explained. When a print signal is input to the interface 1700, it is converted into print data between the gate array 1704 and the MPU 1701. Then, the motor drivers 1706 and 1707 are driven. At the same time, the printhead 3 is driven in accordance with the print data sent to the head driver 1705, thereby printing.

<Head Cartridge>

Figure 11:
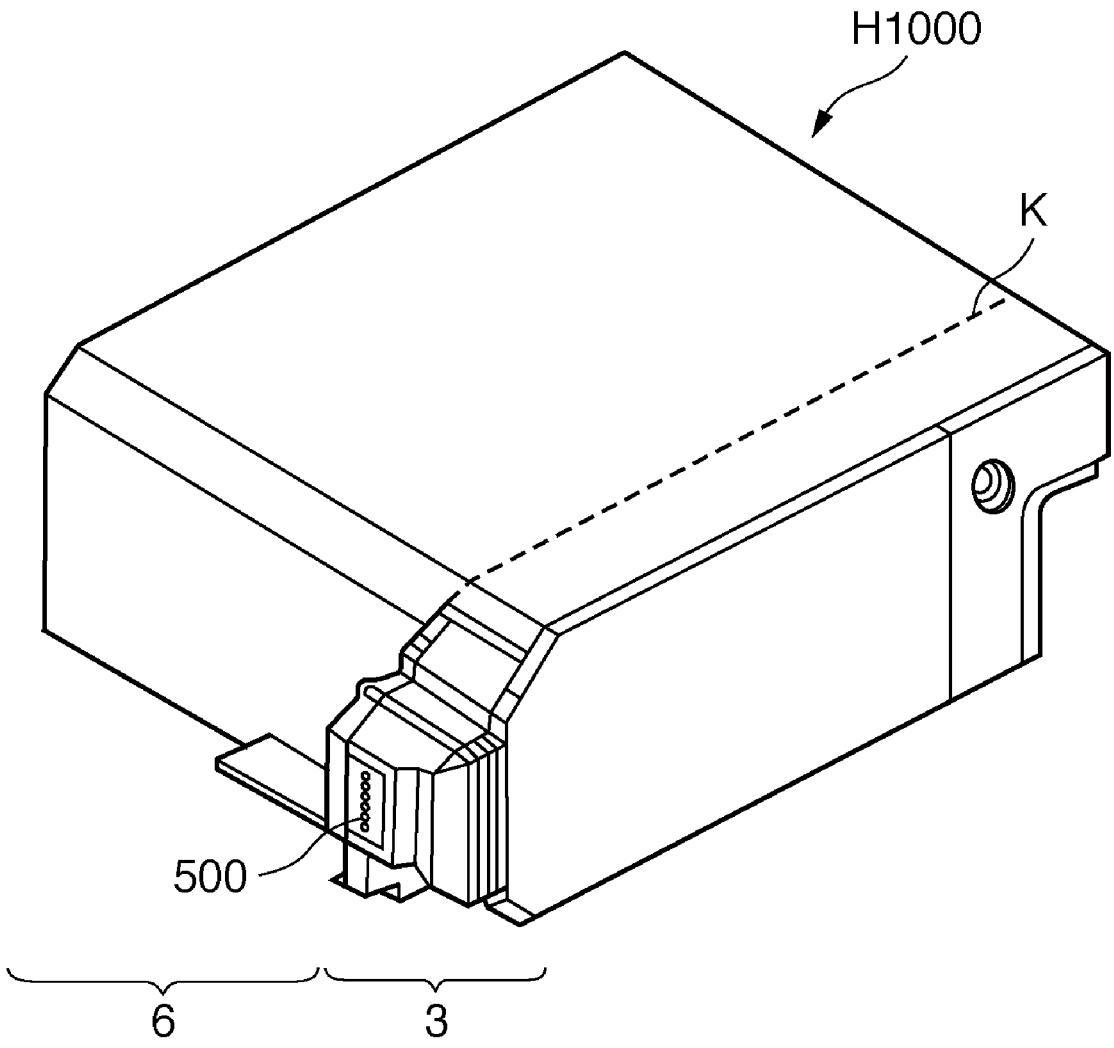
FIG. 11 is a perspective view showing the outer appearance of a head cartridge which integrates an ink tank and printhead.

FIG. 11 is a perspective view showing the outer appearance of the head cartridge H1000 which integrates an ink tank 6 and the printhead 3. Referring to FIG. 11, a dotted line K indicates the boundary between the ink tank 6 and the printhead 3. An ink orifice array 500 is an array of orifices. Ink stored in the ink tank 6 is supplied to the printhead 3 via an ink supply channel (not shown). The head cartridge H1000 has an electrode (not shown) for receiving an electrical signal supplied from the carriage 102 when the head cartridge H1000 is mounted on the carriage 102. The electrical signal drives the printhead 3 to selectively discharge ink from the orifices of the orifice array 500.

<Element Substrate>

Figure 6:
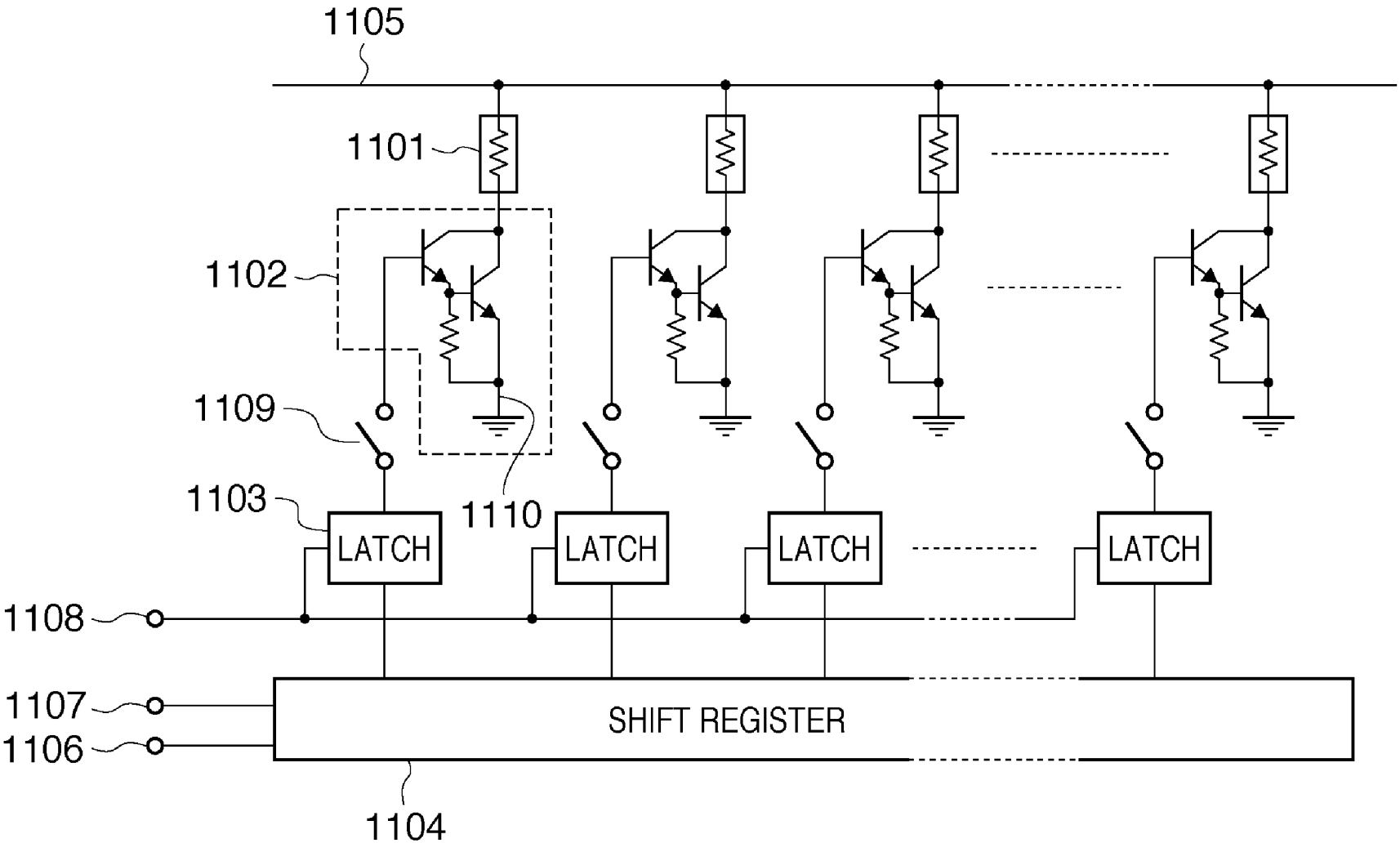
FIG. 6 is a diagram showing an example of the circuit arrangement of the element substrate.

An element substrate according to the present invention will be explained. FIG. 6 shows an example of the circuit arrangement of the element substrate. As shown in FIG. 6, heaters serving as print elements in the printhead, and their driving circuit are formed on a single substrate using a semiconductor process.

Referring to FIG. 6, each heater 1101 generates thermal energy, and each transistor (transistor unit) 1102 supplies a desired current to the heater 1101. A shift register 1104 temporarily stores print data which designates whether to supply a current to each heater 1101 and discharge ink from the orifice of the printhead. The shift register 1104 has a clock (CLK) input terminal 1107. A print data input terminal 1106 serially receives print data DATA for turning on/off the heater 1101. For each heater, a corresponding latch circuit 1103 latches print data of the heater. A latch signal input terminal 1108 inputs a latch signal LT which instructs the latch circuit 1103 of the timing of latch. Each switch 1109 determines the timing to supply a current to the heater 1101. A power supply line 1105 applies a predetermined voltage to the heater to supply a current. A ground line 1110 grounds the heater 1101 via the transistor 1102.

Figure 7:
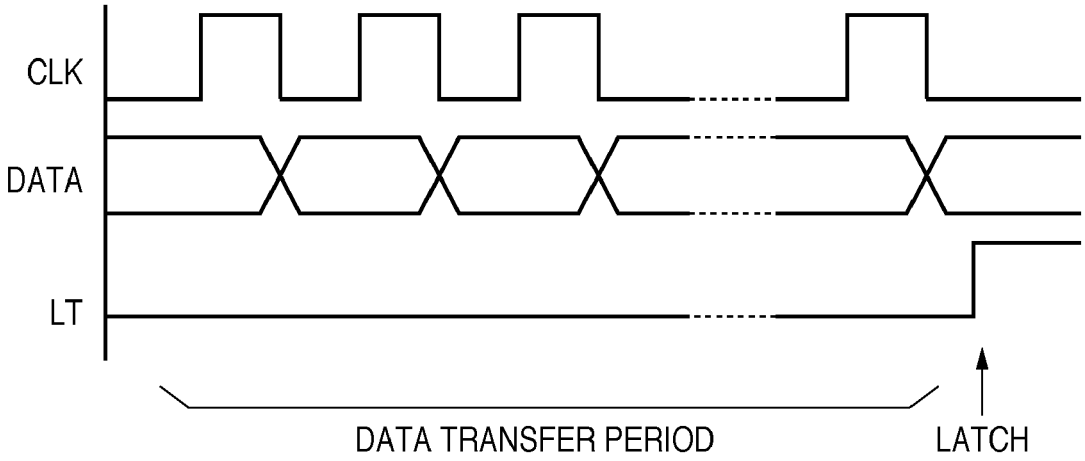
FIG. 7 is an example of a timing chart of various signals input to the element substrate.

FIG. 7 is a timing chart of various signals input to the element substrate shown in FIG. 6. Heater driving and the like on the element substrate shown in FIG. 6 will be explained with reference to FIG. 7.

The clock input terminal 1107 receives clocks CLK by the number of bits of print data stored in the shift register 1104. Data is transferred to the shift register 1104 in synchronism with the leading edge of the clock CLK. Print data DATA for turning on/off each heater 1101 is input from the print data input terminal 1106.

An element substrate in which the number of bits of print data stored in the shift register 1104 is equal to that of heaters and that of power transistors for driving heaters will be explained for descriptive convenience. Pulses of the clock CLK are input by the number of heaters 1101, and the print data DATA is transferred to the shift register 1104. Then, the latch signal LT is input from the latch signal input terminal 1108, and the latch circuit 1103 latches print data corresponding to each heater. The switch 1109 is turned on for an appropriate time. Then, a current flows through the transistor 1102 and heater 1101 via the power supply line 1105 in accordance with the ON time of the switch 1109. The current flows into the GND line 1110. At this time, the heater 1101 generates heat necessary to discharge ink, and the orifice of the printhead discharges ink in correspondence with print data.

Figure 5:
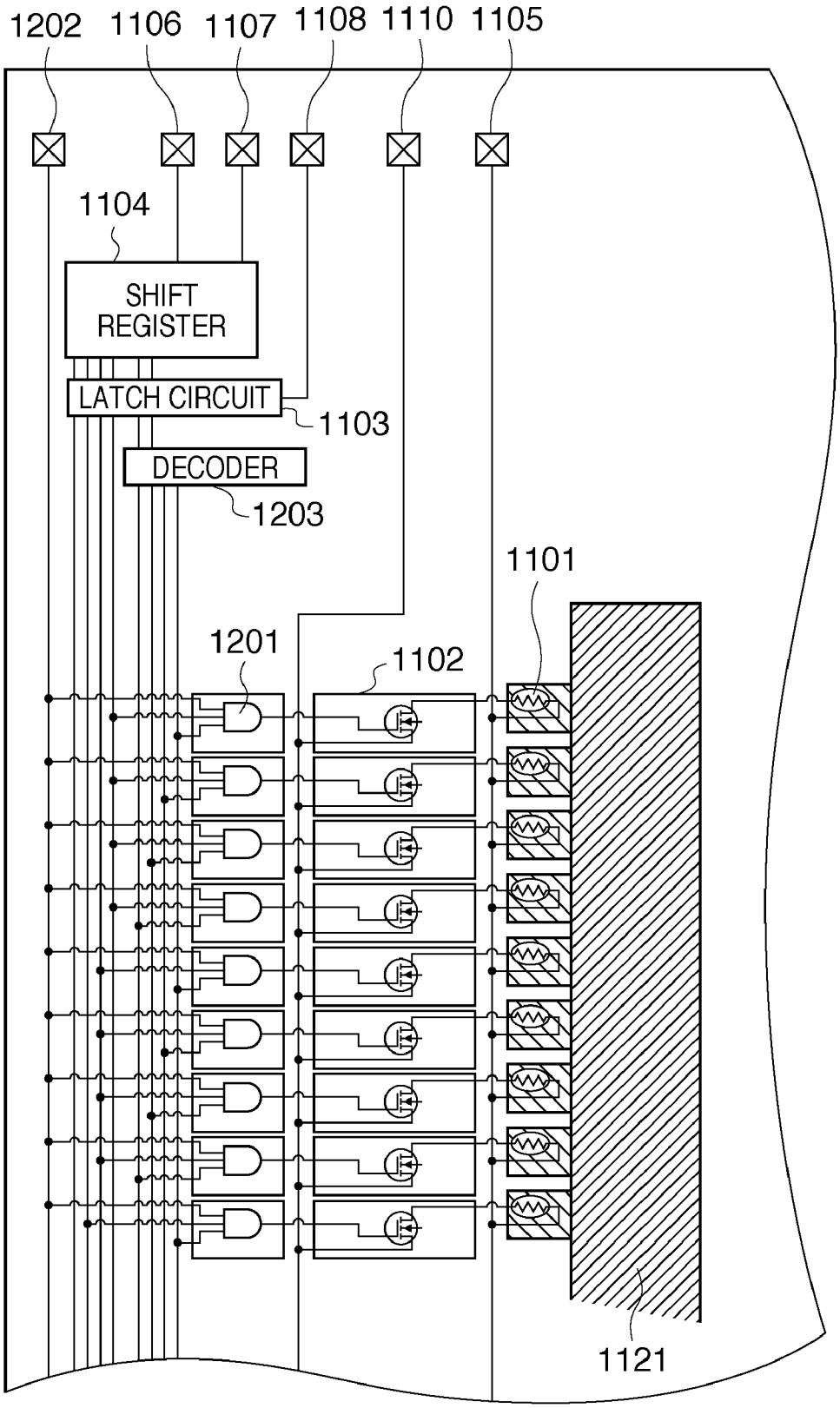
FIG. 5 is a block diagram of an example of a printhead element substrate which employs a time-divisional driving method.

A time-divisional driving method for an element substrate which drives heaters using a shift register in which the number of bits is smaller than that of heaters will be explained with reference to FIG. 5. According to the time-divisional driving method, heaters are divided into a plurality of blocks, and the heaters are driven by changing the time for each block, instead of concurrently driving all the heaters of a single heater array. The time-divisional driving method can decrease the number of concurrently driven heaters.

For example, when dividing all the heaters of a single heater array into N ($N=2^n$: n is a positive integer) blocks and driving them time-divisionally (in N time division), every N adjacent heaters in a single heater array belong to one group. Assume that the heater array includes m groups (the total number of heaters of this heater array is N×m). Data input to the shift register 1104 are block control data for selecting a block, and print data for the block. In FIG. 5, N=4, and every four heaters are driven concurrently.

A decoder 1203 receives block control data, and each AND circuit 1201 receives a block selection signal which is generated by the decoder 1203 on the basis of the block control data. The AND circuit 1201 builds the driving circuit of the heater 1101. The AND circuit 1201 is arranged in correspondence with each heater 1101. The number of bits of block control data necessary for N-time-divisional driving is n. Hence, m-bit print data and n-bit block control data are input from the print data input terminal 1106. Thus, the number of bits in the shift register 1104 and latch circuit 1103 is (n+m) bits. In this element substrate, to drive all the heaters of a hater array once, the gate array 1704 inputs, N times, (n+m)-bit data formed from print data and block control data. A heater driving signal in one-to-one correspondence with a heater is generated based on a print data signal based on the print data, a block selection signal based on the block control data, and a heat enable signal input from a heat enable signal input terminal 1202. The generated heater driving signal drives a corresponding heater.

<Method of Manufacturing Element Substrate and Printhead>

A method of manufacturing an element substrate according to the present invention and a printhead including the element substrate will be explained for a part associated with the present invention.

Figure 8:
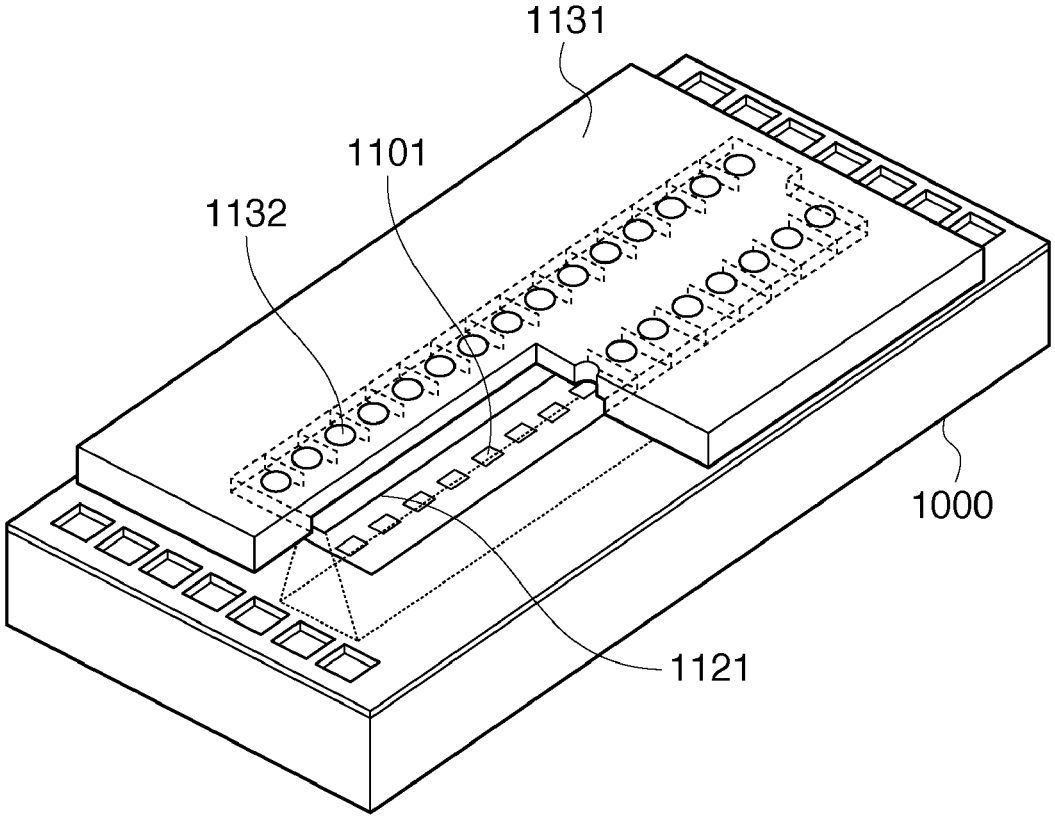
FIG. 8 is a perspective view showing an example of the element substrate.

FIG. 8 is a perspective view showing an example of the element substrate according to the present invention. On the surface of an element substrate 1000, the heaters 1101 and their driving circuits are formed by a semiconductor process using a Si wafer with 0.5 to 1 mm thickness. Each orifice 1132 for discharging ink is formed by photolithography using an orifice forming member 1131 made of a resin material, together with an ink channel wall for forming an ink channel corresponding to each heater 1101 of the element substrate 1000.

To supply ink to each orifice 1132, an ink supply port 1121, which is a long groove-like through hole with a surface inclined from the lower surface to upper surface of the element substrate, is formed by anisotropic etching using the crystal orientation of the Si wafer.

The element substrate having this structure can build a head cartridge by connecting the ink supply port 1121 and a channel member for guiding ink to the ink supply port 1121, and combining them with a container which stores ink. Particularly when the head cartridge is configured by combining containers which store inks of a plurality of colors, and element substrates for the respective colors, color printing can be performed using this head cartridge.

<Driving Circuit in Element Substrate>

Several embodiments of a heater array and shift register in the element substrate according to the present invention will be explained below in detail.

Element substrates in the following embodiments are those for an inkjet printhead. In these element substrates, a plurality of heater arrays each including a plurality of heaters are arranged along the ink supply port 1121. More specifically, each element substrate includes a heater array (first print element array) made up of a relatively large number of heaters serving as print elements, and a heater array (second print element array) made up of a relatively small number of heaters as printing elements. In the following embodiments, both the number of heaters (number of print elements) and the heater arrayed density differ between heater arrays to clarify features of the present invention. However, the present invention is also applicable to a case where the heater arrayed density is equal and only the number of heaters differs between heater arrays.

First Embodiment

An element substrate according to the first embodiment includes a heater array in which 16 heaters 1101 are arranged at low density (600 dpi), and a heater array in which 32 heaters 1101 are arranged at high density (1,200 dpi). These juxtaposed heater arrays are equal in length. The heater array in which heaters are arranged at low density and the heater array in which heaters are arranged at high density are driven by the same time-divisional count. This time-divisional driving uses a common clock and latch signal within the element substrate.

Figure 12:
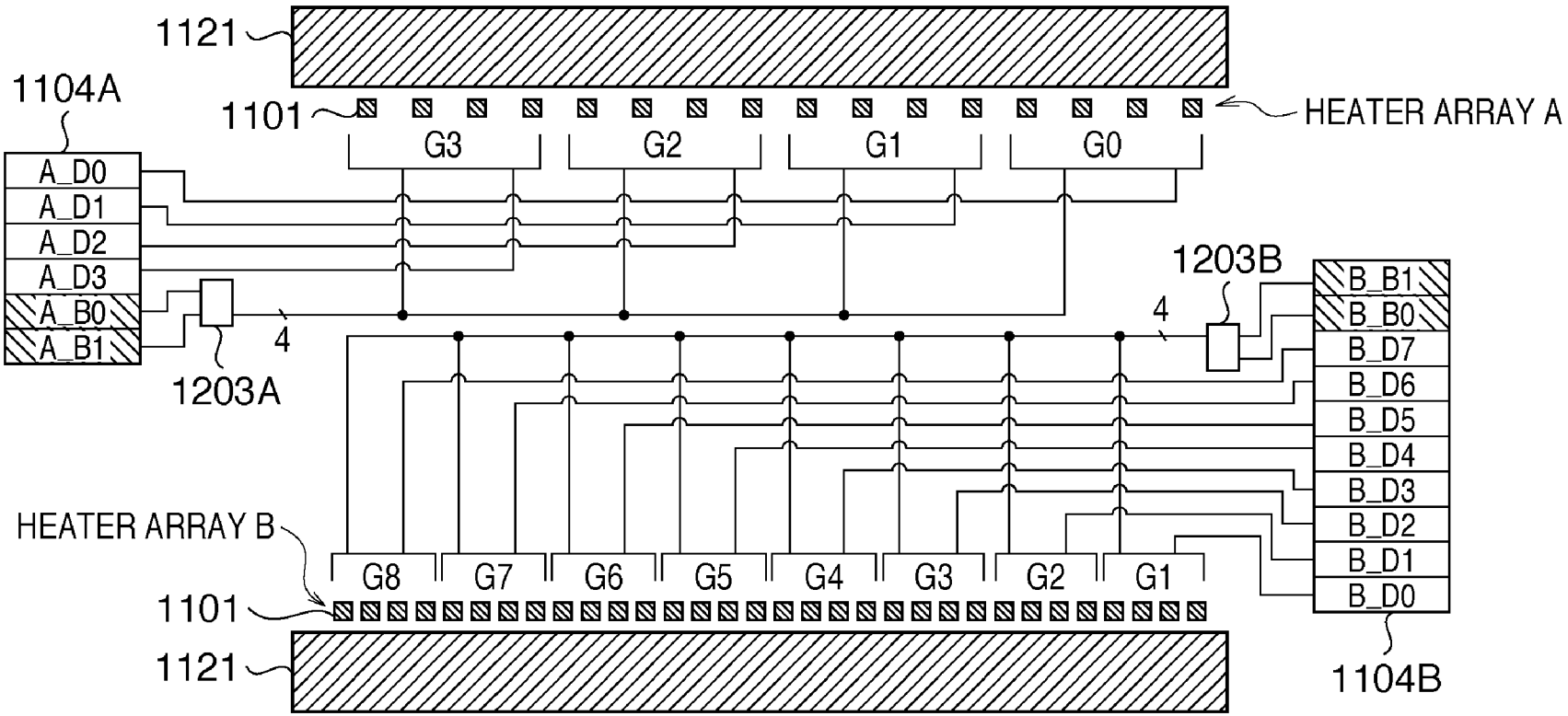
FIG. 12 is a schematic view of an element substrate for comparison with the element substrate of the first embodiment.

FIG. 12 is a schematic view of an element substrate for comparison with the element substrate of the first embodiment. This element substrate includes heater arrays A and B, and two (equal in number to heater arrays) shift registers 1104A and 1104B and two decoders 1203A and 1203B that correspond to the respective heater arrays. For descriptive convenience, the latch circuit and the driving circuit (AND circuit and transistor) shown in FIG. 5 are not illustrated. The heater array A includes four groups G0, G1, G2, and G3 each made up of four adjacent heaters. Also, the heater array A includes four blocks each made up of a total of four heaters which are selected one by one from the respective groups and are driven concurrently. The heater array B includes eight groups each made up of four adjacent heaters. The heater array B has the same arrangement as that of the heater array A. Ink supply ports 1121 are formed along the heater arrays.

In this element substrate, a print data signal and block selection signal are assigned to each heater array. The heater array A will be explained. More specifically, the shift register corresponding to the heater array A holds data of 6 bits. The data of 6 bits are print data A_D0, A_D1, A_D2, and A_D3 of 4 bits for the four groups G0, G1, G2, and G3, and block control data A_B0 and A_B1 of 2 bits for selecting one block to be driven from the four blocks.

The print data A_D0 corresponds to the group G0. Similarly, the print data A_D1, A_D2, and A_D3 correspond to the groups G1, G2, and G3, respectively. A gate array 1704 sequentially transfers data of 6 bits in synchronism with a timing signal. Heaters are driven based on the transferred control data and print data. By this arrangement, heaters are driven time-divisionally.

The heater array B will be explained. The shift register and the latch circuit (not shown) corresponding to the heater array B hold data of 10 bits. More specifically, the shift register holds print data B_D0 to B_D7 of 8 bits for the eight groups, and block control data B_B0 and B_B1 of 2 bits for selecting a block to be driven from the four blocks. As for time-divisional driving control of heaters, control of the heater array A and that of the heater array B are the same.

However, the numbers of data bits held in the shift registers corresponding to these heater arrays differ from each other by 4 bits. When receiving a signal of the same type, the difference in the number of bits is the difference in size. This decreases the circuit layout efficiency of the element substrate. Since the time taken to input print data is different, the data transfer efficiency is also low.

Figure 1A:
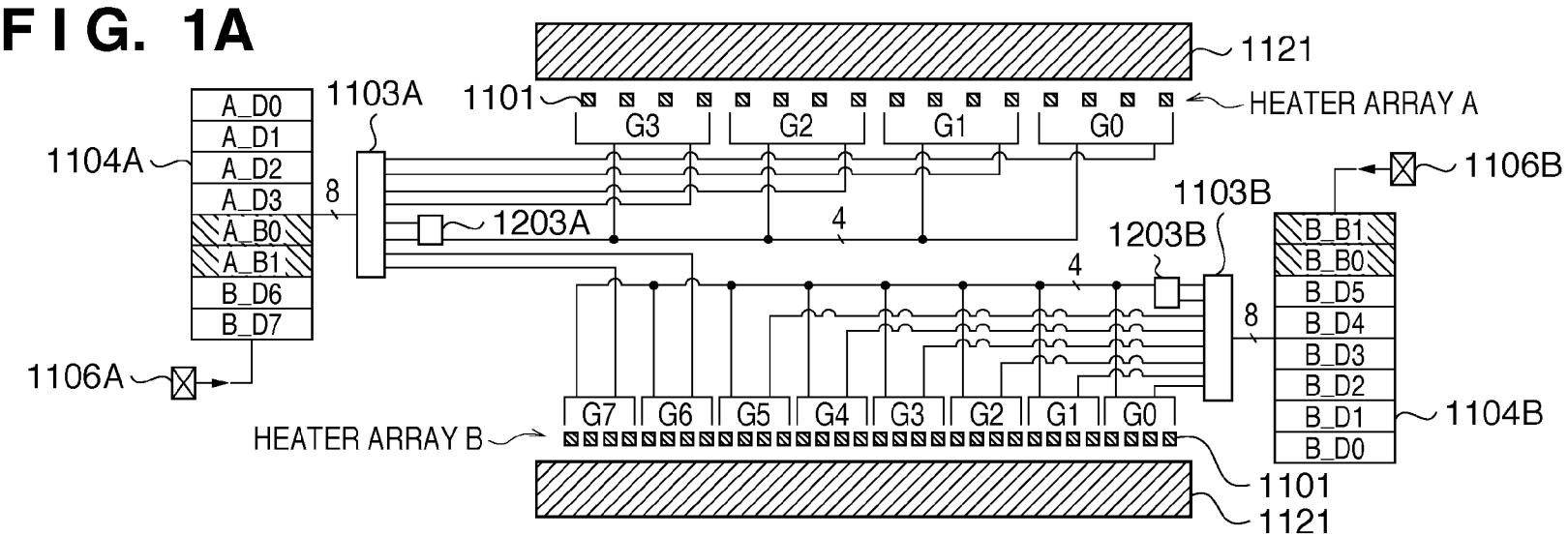
FIGS. 1A and 1B are schematic views of an element substrate according to the first embodiment of the present invention.

FIG. 1A is a schematic view of an element substrate according to the first embodiment.

The arrangements of the heater arrays A and B in the element substrate shown in FIG. 1A are the same as those in the element substrate shown in FIG. 12. The operation principle of time-divisional driving is also the same as that in FIG. 12. The difference in arrangement between the element substrates in FIGS. 1A and 12 will be explained, and a description of the same part will not be repeated.

The shift register 1104A holds print data to be supplied to the driving circuit of the heater array A and some print data to be supplied to part of the driving circuit of the heater array B. More specifically, data serially transferred to the shift register 1104A are data of 8 bits. The data of 8 bits are assigned to three areas of the shift register. Bits 0 to 3 in the first area are print data used in the heater array A. Bits 4 and 5 in the second area are assigned to block driving control data of the heater array A. Bits 6 and 7 in the third area are print data used in the heater array B. In FIG. 1A, bits 0 to 3 of the shift register 1104A hold the print data A_D0, A_D1, A_D2, and A_D3, and bits 6 and 7 of the shift register 1104A hold the print data B_D6 and B_7. In this way, data corresponding to another heater array are assigned to predetermined bit positions (range) of data to be transferred.

To the contrary, the shift register 1104B corresponding to the heater array B holds only data associated with the heaters of the heater array B. More specifically, the shift register 1104B holds the print data B_D0, B_D1, B_D2, B_D3, B_D4, and B_D5 corresponding to the heater array B. This arrangement equally sets, to 8 bits, the numbers of data bits held in the two shift registers.

The printhead includes terminals 1106A and 1106B for inputting data to the respective shift registers, and uses a common clock signal line (CLK 1107). The shift register is configured by successively arraying circuit elements with the same arrangement by the number of data bits to be held. A circuit which corresponds to one data signal and is configured by successively arraying circuit elements with the same arrangement will be defined as a shift register circuit. Both data associated with the heater array A and data associated with the heater array B are input from the data signal line of the shift register circuit of the heater array A.

A latch circuit 1103A will be explained. The latch circuit 1103A uses an 8-bit parallel bus to latch data held in the shift register 1104A. The latch circuit 1103A outputs A_D0 to G0, A_D1 to G1, A_D2 to G2, and A_D3 to G3. The decoder 1203A receives block control data of 2 bits latched by the latch circuit 1103A, generates control data of 4 bits, and outputs them to the respective groups. In accordance with the control data, a heater to be driven is selected from each group. Further, the latch circuit 1103A outputs B_D6 to G6 of the heater array B, and B_D7 to G7 of the heater array B. Next, a latch circuit 1103B will be explained. The latch circuit 1103B outputs data to the groups G0 to G5 of the heater array B. For example, the latch circuit 1103B outputs B_D0 to G0, B_D1 to G1, and B_D5 to G5. The decoder 1203B operates similarly to the decoder 1203A.

Figure 16A:
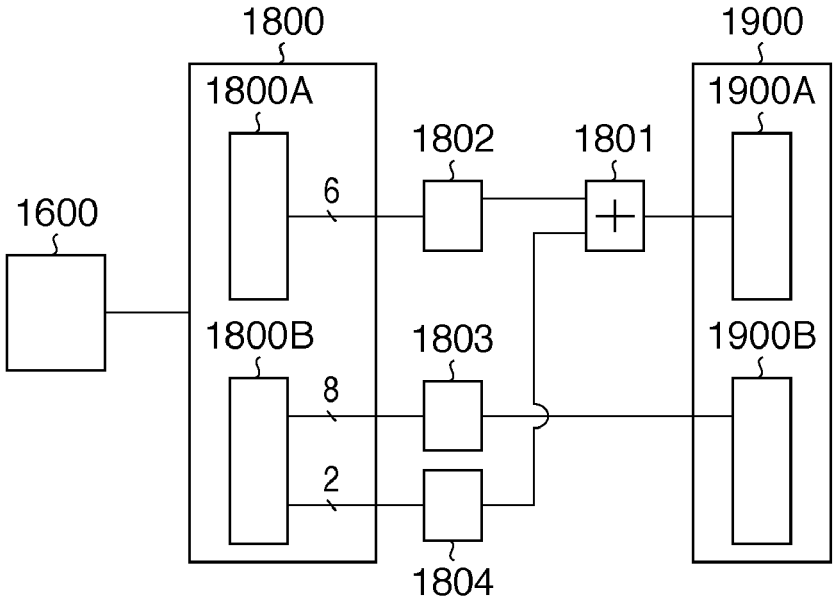
FIGS. 16A and 16B are circuit diagrams for explaining in detail the control arrangement of FIG. 9 according to the first and third embodiments, respectively.

FIG. 16A is a circuit diagram of the control circuit of an inkjet printing apparatus according to the first embodiment. Processing for print data and block control data will be explained with reference to FIG. 16A.

The above-described gate array 1704 includes a data generation unit 1800 which generates data to be transferred to the printhead, and a transfer unit 1900 which transfers data generated by the data generation unit 1800. A DRAM 1703 includes a print buffer 1600 which buffers print data. The data generation unit 1800 generates print data A_D0 to A_D3 of 4 bits used in the heater array A, print data B_D0 to B_D7 of 8 bits used in the heater array B, block control data A_B0 and A_B1 for driving the heater array A, and block control data B_B0 and B_B1 for driving the heater array B. Although not described in detail, the data generation unit 1800 generates column binary data when data buffered in the print buffer are raster multilevel data.

A buffer 1800A buffers the generated print data A_D0 to A_D3 and block control data A_B0 and A_B1. A buffer 1800B buffers the generated print data B_D0 to B_D7 and block control data B_B0 and B_B1. A latch circuit 1802 latches data of the buffer 1800A. A latch circuit 1803 latches the print data B_D0 to B_D5 and block control data B_B0 and B_B1 out of data in the buffer 1800B. A latch circuit 1804 latches the print data B_D6 and B_D7 out of data in the buffer 1800B.

A data coupling unit 1801 which couples outputs from the latch circuits 1802 and 1804 holds a total of 8 bits: the print data A_D0 to A_D3, block control data A_B0 and A_B1, and print data B_D6 and B_D7. The transfer unit 1900 includes a transfer buffer 1900A which buffers data to be transferred to the shift register 1104A in FIG. 1A, and a transfer buffer 1900B which buffers data to be transferred to the shift register 1104B in FIG. 1B. Each of the transfer buffers 1900A and 1900B transfers 8-bit data. The data coupling unit 1801 outputs data to the transfer buffer 1900A, whereas the latch circuit 1803 outputs data to the transfer buffer 1900B. This arrangement generates data to be transferred to the printhead.

A carriage 102 of the printing apparatus has terminals which are connected to the terminals 1106A and 1106B when the printhead is mounted.

Figure 1B:
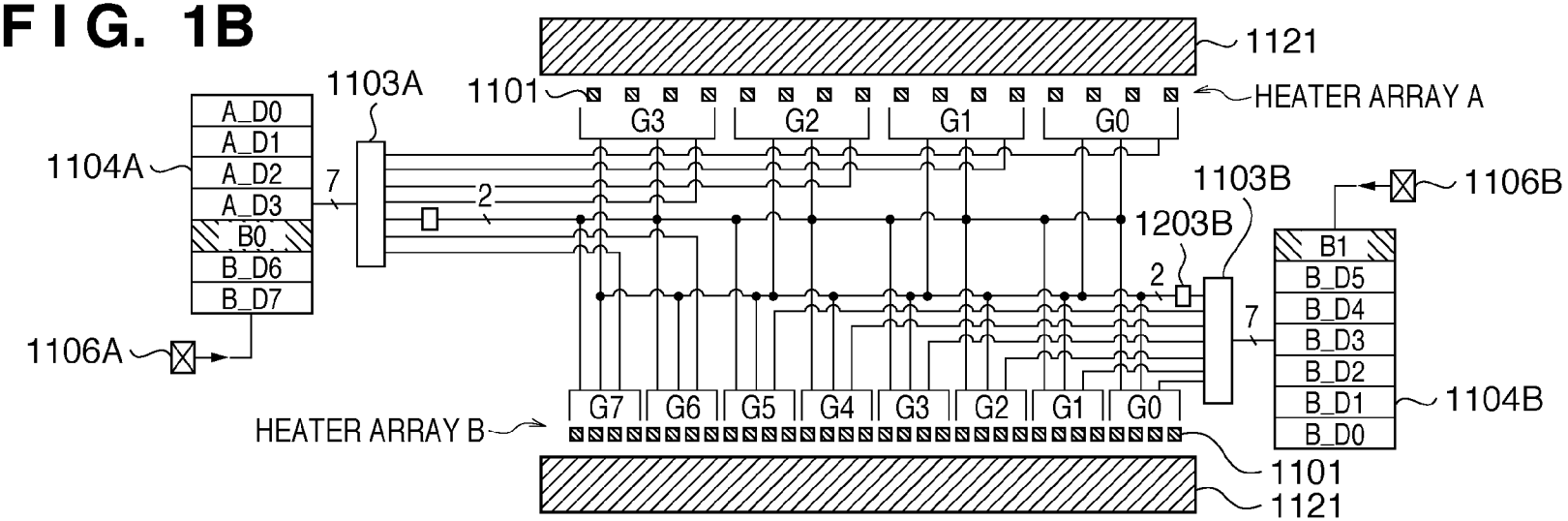

FIG. 1B is a schematic view of another element substrate according to the first embodiment. A description of the same part as that in FIG. 1A will not be repeated, and a difference will be explained. The arrangements of the heater arrays A and B in the element substrate shown in FIG. 1B are the same as those in the element substrate shown in FIGS. 12 and 1A.

The time-divisional counts of the heater arrays A and B are equal to each other, so a common block selection signal can be supplied to the driving circuits of the heater arrays A and B. Each shift register of the element substrate shown in FIG. 1A holds block control data of 2 bits (for four blocks) for generating a block selection signal. To the contrary, in the element substrate shown in FIG. 1B, a common block selection signal is supplied to the driving circuits of the heater arrays A and B. More specifically, a shift register for supplying a print data signal to the driving circuit of the heater array A holds 1-bit block control data B0. A shift register for supplying a print data signal to only the driving circuit of the heater array B holds 1-bit block control data B1. Then, 2-bit signals are respectively output from the decoders 1203A and 1203B to the driving circuits of the heater arrays A and B. As a result, the element substrate shown in FIG. 1B can decrease the number of data bits held in the shift register by 2 bits from that in the element substrate shown in FIG. 1A. The block control data B0 and B1 held in these shift registers can also be exchanged.

In the heater array A of the first embodiment, the number of print elements which form the array is smaller than that in the heater array B. In a conventional arrangement, the number of data bits held in a shift register circuit arranged for a print element array made up of a large number of print elements is greater than that of data bits held in a shift register circuit arranged for a print element array made up of a small number of print elements. For this reason, the data transfer speed of the shift register circuit which holds a larger number of data bits decreases. According to the present invention, the number of bits in a shift register circuit corresponding to a print element array made up of a small number of print elements is increased. Further, the number of bits in a shift register circuit corresponding to a print element array made up of a large number of print elements is decreased. This can make the numbers of bits of the shift register circuits close to each other, reducing the data transfer speed difference between the two shift register circuits.

The numbers of data bits held in shift register circuits and latch circuits may also be equal to each other. This arrangement can efficiently lay out circuits and efficiently transfer data to each print element.

Second Embodiment

The second embodiment will be explained. A description of the same contents as those in the first embodiment will not be repeated, and a difference will be explained. In an element substrate according to the second embodiment, the number of heaters of a heater array in which heaters are arranged at low density (300 dpi) is eight, and that of heaters of a heater array in which heaters are arranged at high density (1,200 dpi) is 32. These heater arrays are equal in length. The heater array in which heaters are arranged at low density and the heater array in which heaters are arranged at high density have the same number of groups and different numbers of blocks. This time-divisional driving uses a common clock and latch signal within the element substrate.

Figure 13:
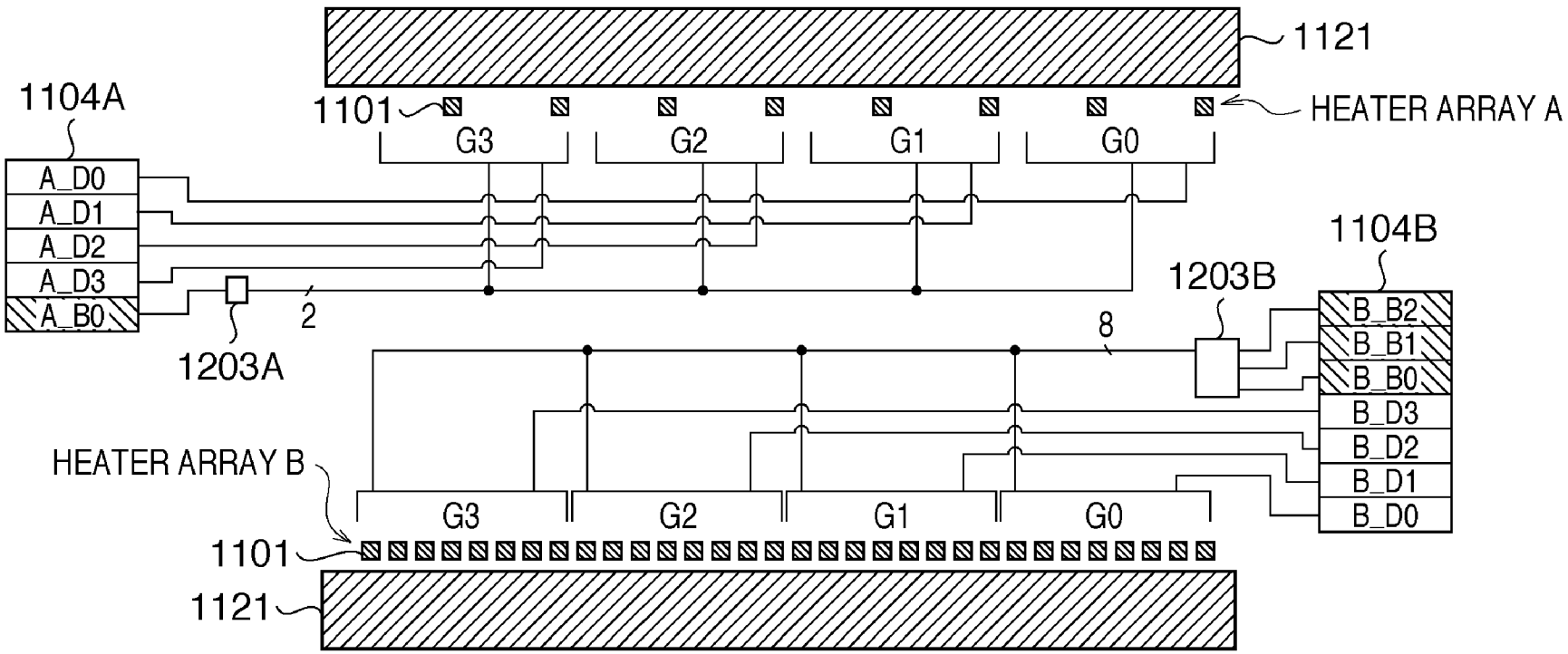
FIG. 13 is a schematic view of an element substrate for comparison with the element substrate of the second embodiment.

FIG. 13 is a schematic view of a conventional element substrate for comparison with the element substrate of the second embodiment. This element substrate includes heater arrays A and B, and two shift registers 1104A and 1104B and two decoders 1203A and 1203B that correspond to the respective heater arrays. The heater array A includes four groups each made up of two adjacent heaters. Also, the heater array A includes two blocks each made up of a total of four heaters which are selected one by one from the respective groups and are driven concurrently. The heater array B includes four groups each made up of eight adjacent heaters. The heater array B includes eight blocks each made up of a total of four heaters which are selected one by one from the respective groups and are driven concurrently.

In this element substrate, a driving circuit (not shown) receives a print data signal and block selection signal for each heater array. The shift register and a latch circuit (not shown) corresponding to the heater array A hold data of 5 bits. More specifically, the shift register holds print data A_D0 to A_D3 of 4 bits for the four groups, and block control data A_B0 of 1 bit for selecting a block to be driven from the two blocks. In contrast, the shift register and a latch circuit (not shown) corresponding to the heater array B hold data of 7 bits. More specifically, the shift register holds print data B_D0 to B_D3 of 4 bits for the four groups, and block control data B_B0 to B_B2 of 3 bits for selecting a block to be driven from the eight blocks. In this way, the numbers of data bits held in the shift registers differ from each other by 2 bits.

Figure 2:
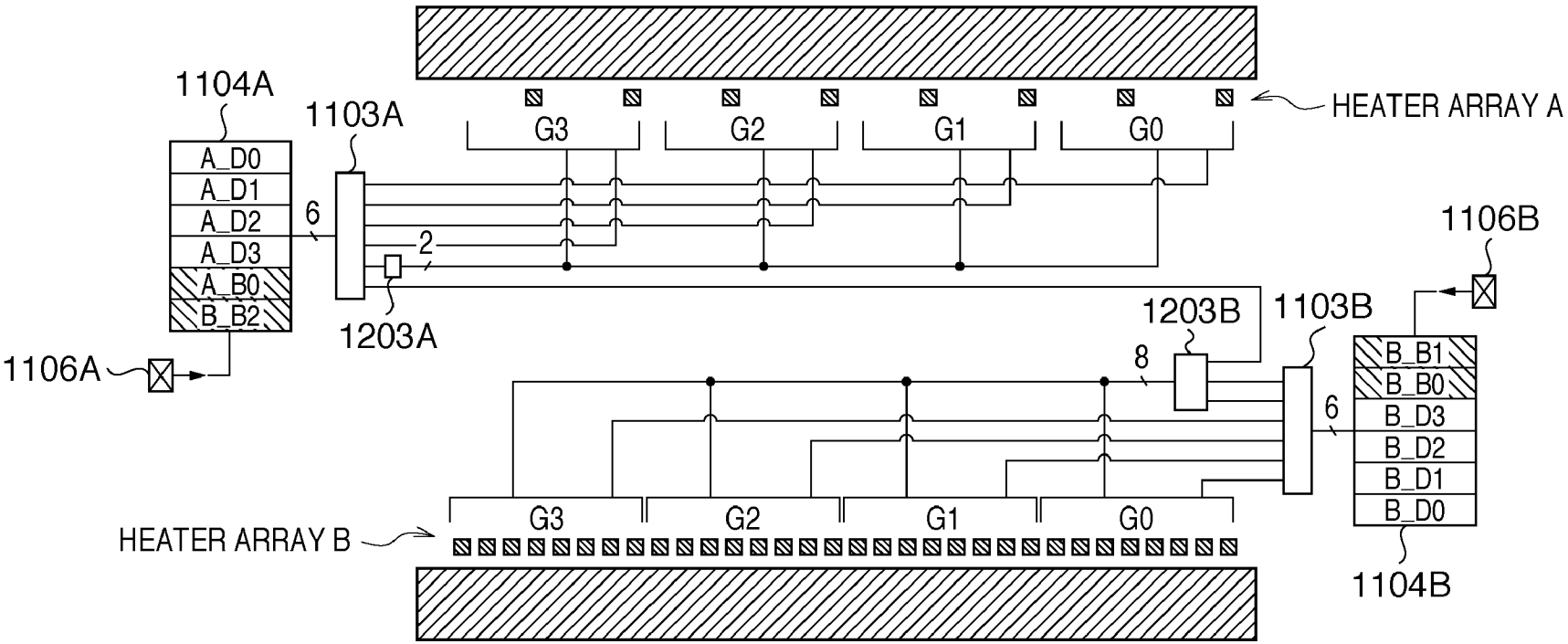
FIG. 2 is a schematic view of an element substrate according to the second embodiment of the present invention.

FIG. 2 is a schematic view of an element substrate according to the second embodiment.

The arrangements of the heater arrays A and B in the element substrate of FIG. 2 are the same as those in the element substrate of FIG. 13. The arrangement of the element substrate in FIG. 2 is different from that of the element substrate in FIG. 13 in the following point.

The shift register 1104A holds the block control data A_B0 for driving heaters in the heater array A for each block, and the block control data B_B2 for driving heaters in the heater array B for each block. The shift register 1104B holds the block control data B_B0 and B_B1 for generating a block selection signal to be supplied to the driving circuit of the heater array B. The decoder 1203A receives the block control data A_B0 via a latch circuit 1103A, and outputs it to the groups G0, G1, G2, and G3 of the heater array A. The decoder 1203B receives the block control data B_B2 via the latch circuit 1103A. The decoder 1203B receives the block control data B_B0 and B_B1 via a latch circuit 1103B. The decoder 1203B decodes the 3-bit data to generate an 8-bit signal. The decoder 1203B outputs the 8-bit signal to the groups G0, G1, G2, and G3 of the heater array B. This arrangement equally sets, to 6 bits, the numbers of data bits held in the two shift registers.

Data input to the shift register 1104A of the heater array A are a total of three types: print data associated with the heater array A, block control data associated with the heater array A, and block control data associated with the heater array B. Data input to the shift register 1104B of the heater array B are a total of two types: print data associated with the heater array B, and block control data associated with the heater array B.

Block control data for the heater array B that is input to and held in the shift register for the heater array A acts on the print elements of the heater array B.

As described above, the numbers of data bits held in the shift register circuits and latch circuits of respective print element arrays having different numbers of print elements become equal to each other. This arrangement can efficiently lay out circuits and efficiently transfer data to each print element. Note that an inkjet printing apparatus according to this embodiment includes a data generation unit and transfer unit, similar to the first embodiment. The inkjet printing apparatus of the second embodiment is simply different from that of the first embodiment in the data contents and the positions of bits which form data. Thus, a description thereof will be omitted.

Third Embodiment

The third embodiment will now be explained. A description of the same contents as those in the first and second embodiments will not be repeated, and a difference will be explained. An element substrate according to the third embodiment includes three heater arrays and three shift registers. The number of heaters of a heater array in which heaters are arranged at low density (300 dpi) is eight. The number of heaters of a heater array in which heaters are arranged at intermediate density (600 dpi) is 16. The number of heaters of a heater array in which heaters are arranged at high density (1,200 dpi) is 32. These heater arrays are equal in length. The time-divisional driving uses a common clock and latch signal within the element substrate.

Figure 14:
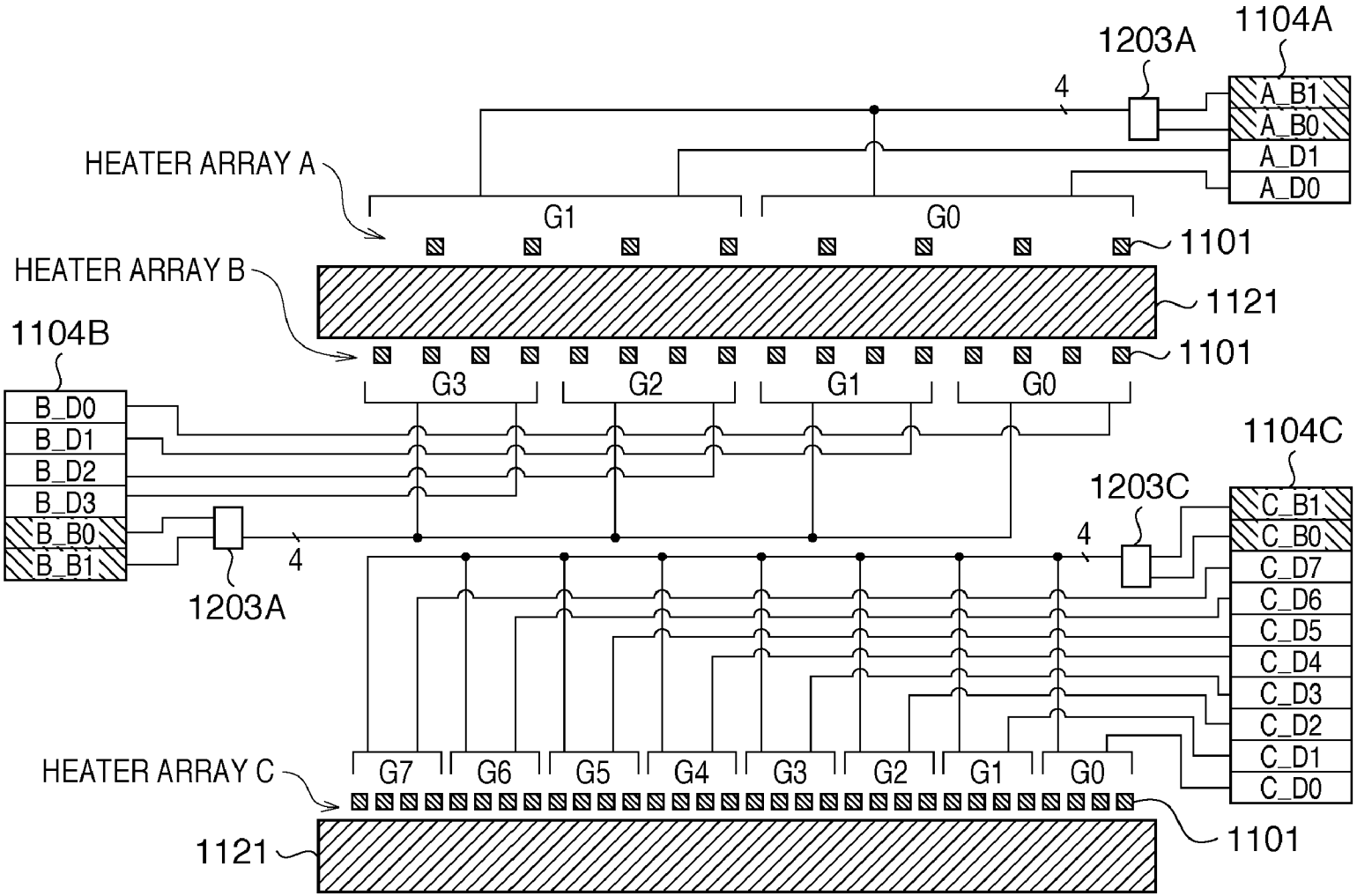
FIG. 14 is a schematic view of an element substrate for comparison with the element substrate of the third embodiment.

FIG. 14 is a schematic view of a conventional element substrate for comparison with the element substrate of the third embodiment. This element substrate includes heater arrays A, B, and C, and three shift registers 1104A, 1104B, and 1104C and three decoders 1203A, 1203B, and 1203C that correspond to the respective heater arrays. Each shift register corresponds to only print elements arranged in one print element array. The heater array A includes two groups G0 and G1 each made up of four adjacent heaters. Also, the heater array A includes four blocks each made up of a total of two heaters which are selected one by one from the respective groups and are driven concurrently. The heater array B includes four groups G0, G1, G2, and G3 each made up of four adjacent heaters. The heater array B includes four blocks each made up of a total of four heaters which are selected one by one from the respective groups and are driven concurrently. The heater array C includes eight groups G0, G1, G2, G3, G4, G5, G6, and G7 each made up of four adjacent heaters. The heater array C includes four blocks each made up of a total of eight heaters which are selected one by one from the respective groups and are driven concurrently.

In this element substrate, a driving circuit (not shown) receives a print data signal and block selection signal for each heater array. The shift register and a latch circuit (not shown) corresponding to the heater array A hold data of 4 bits. More specifically, the shift register holds print data A_D0 and A_D1 of 2 bits for the two groups, and block control data A_B0 and A_B1 of 2 bits for selecting a block to be driven from the four blocks. The shift register and a latch circuit (not shown) corresponding to the heater array B hold data of 6 bits. More specifically, the shift register holds print data B_D0 to B_D3 of 4 bits for the four groups, and block control data B_B0 and B_B1 of 2 bits for selecting a block to be driven from the four blocks. The shift register and a latch circuit (not shown) corresponding to the heater array C hold data of 10 bits. More specifically, the shift register holds print data C_D0 to C_D7 of 8 bits for the eight groups, and block control data C_B0 and C_B1 of 2 bits for selecting a block to be driven from the four blocks. The numbers of data bits held in the shift registers differ from each other by a maximum of 4 bits.

Figure 3A:
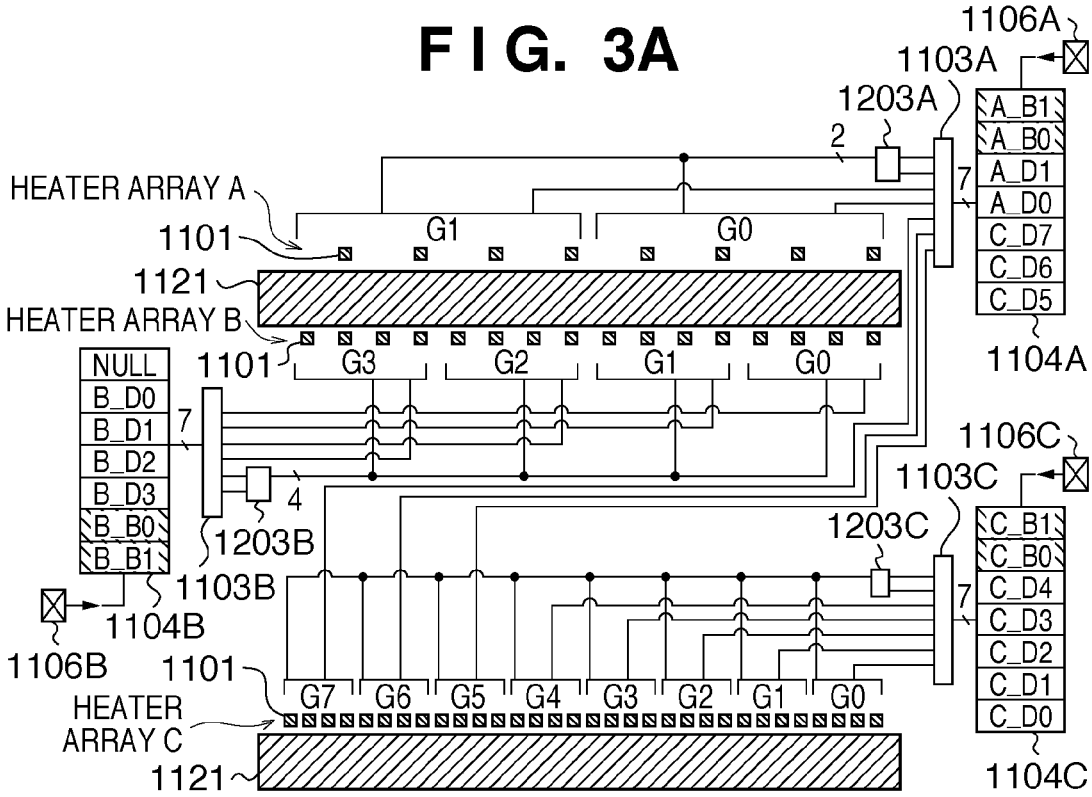
FIGS. 3A and 3B are schematic views of an element substrate according to the third embodiment of the present invention.

FIG. 3A is a schematic view of an element substrate according to the third embodiment.

The arrangements of the heater arrays A, B, and C in the element substrate shown in FIG. 3A are the same as those in the element substrate shown in FIG. 14. The arrangement of the element substrate shown in FIG. 3A is different from that of the element substrate in FIG. 14 in the following point.

In the element substrate of FIG. 3A, the shift register 1104A holds the print data C_D5 to C_D7 for generating a print data signal to be supplied to the driving circuit of the heater array C. Also, the shift register 1104B corresponding to the heater array B has a dummy (NULL) bit. The shift register 1104C corresponding to the heater array C holds the print data C_D0 to C_D4 and block control data C_B0 and C_B1. This arrangement equally sets, to 7 bits, the numbers of data bits held in the three shift registers.

A terminal 1106A receives print data and block control data associated with the print elements of the heater array A, and some print data associated with those of the heater array C. The shift register 1104A of the heater array A holds these data. A terminal 1106B receives print data and block control data associated with the print elements of the heater array B. The shift register 1104B holds these data. A terminal 1106C receives the remaining print data and block control data associated with the print elements of the heater array C. The shift register 1104C holds these data.

Some print data associated with the heater array C that are held in the shift register of the heater array A are output from the shift register of the heater array A and act on the print elements of the heater array C.

Figure 16B:
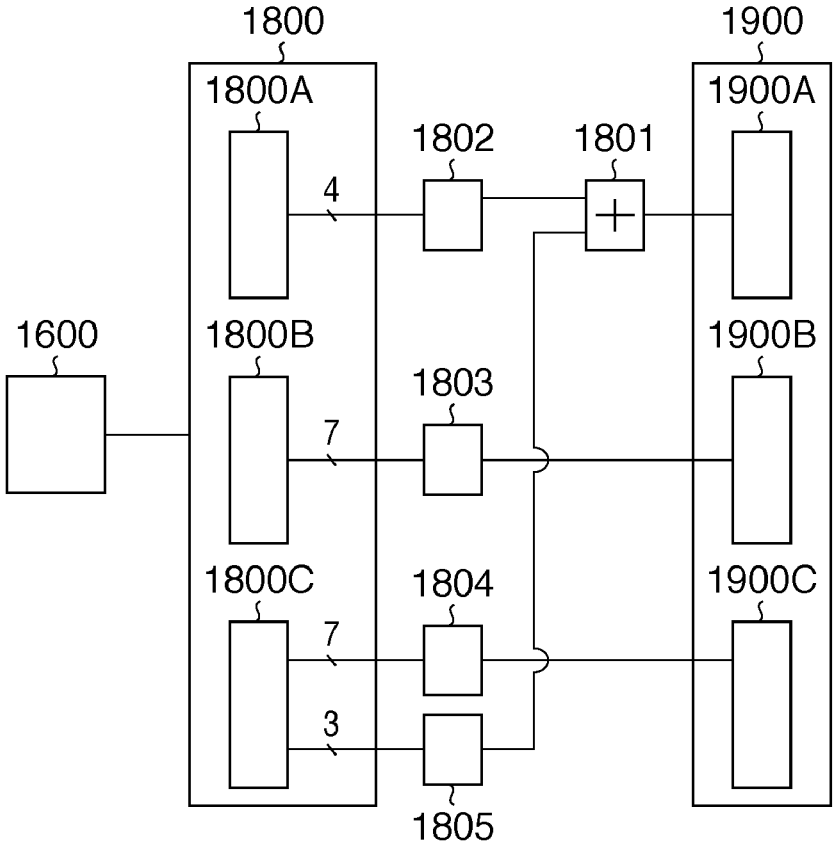

FIG. 16B is a circuit diagram of the control circuit of an inkjet printing apparatus according to the third embodiment. A difference from the first embodiment will be explained, and a description of the same contents will not be repeated.

The third embodiment is different from the first embodiment in that the number of heater arrays is two in the first embodiment, but three in the third embodiment. Hence, the inkjet printing apparatus according to the third embodiment includes buffers 1800A, 1800B, and 1800C, and transfer buffers 1900A, 1900B, and 1900C in correspondence with the heater arrays A, B, and C. The first embodiment employs a circuit arrangement which synthesizes some data corresponding to the heater array B with data corresponding to the heater array A. In contrast, the third embodiment employs a circuit arrangement which synthesizes some data corresponding to the heater array C with data corresponding to the heater array A.

More specifically, a data generation unit 1800 generates data of 10 bits corresponding to the heater array C, and buffers them in the buffer 1800C. The buffer 1800C outputs 7 bits out of the 10 bits to a latch circuit 1804, and 3 bits out of the 10 bits to a latch circuit 1805. The latch circuit 1805 outputs the 3 bits to a data coupling unit 1801. The data coupling unit 1801 couples the data of 3 bits, and data of 4 bits that are output from the latch circuit 1802 for the heater array A. The data coupling unit 1801 outputs the coupled data to the transfer buffer 1900A. In the third embodiment, data corresponding to the heater array B are transferred to the printhead without any process.

Figure 3B:
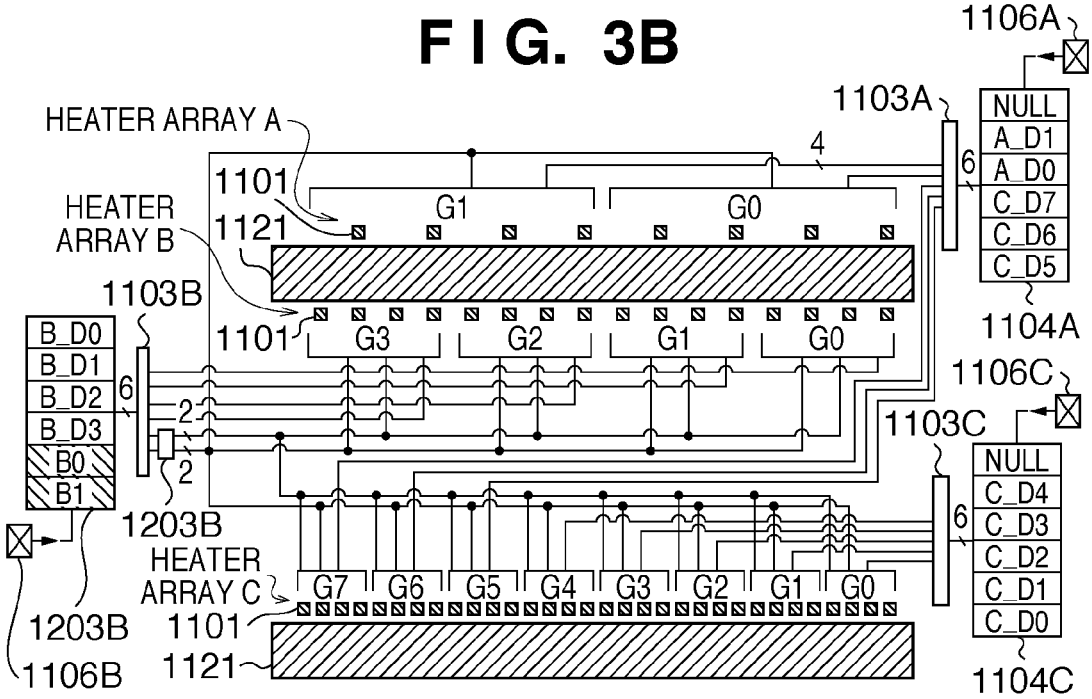

FIG. 3B is a schematic view of another element substrate according to the third embodiment. The arrangements of the heater arrays A, B, and C in the element substrate shown in FIG. 3B are the same as those in the element substrates shown in FIGS. 14 and 3A. The time-divisional counts of the heater arrays A, B, and C are equal to each other, so a common block selection signal is supplied to the driving circuits of the heater arrays A, B, and C. Each shift register of the element substrate shown in FIG. 3A holds block control data of 2 bits for generating a block selection signal.

To the contrary, in the element substrate shown in FIG. 3B, the shift register 1104B which supplies a print data signal to the driving circuit of the heater array B holds a total of 2 bits: block control data B0 and B1. The block control data B0 and B1 input to the shift register 1104B are output to the respective heater arrays via the decoder 1203B. The shift register 1104A corresponding to the heater array A and the shift register 1104C corresponding to the heater array C receive only print data. That is, the shift registers 1104A and 1104C do not hold block control data. In addition, dummy (NULL) bits are set in the shift register 1104A which supplies a print data signal to the driving circuit of the heater array A, and the shift register 1104C which supplies a print data signal to only the driving circuit of the heater array C. This arrangement equally sets, to 6 bits, the numbers of data bits held in the three shift registers. Accordingly, the element substrate shown in FIG. 3B can decrease the total number of data bits held in the shift registers, compared with the element substrate shown in FIG. 3A. The element substrate shown in FIG. 3B can also decrease the number of decoders.

In the element substrate shown in FIG. 3B, the terminal 1106A receives print data associated with the print elements of the heater array A, and some print data associated with those of the heater array C. The shift register 1104A holds these data. Out of the data held in the shift register 1104A, one predetermined bit is null data. This also applies to the shift register 1104C to be described later.

The terminal 1106B receives the block control data B0 and B1 common to the heater arrays, and the shift register 1104B holds them. The shift register 1104B further holds data corresponding to G0 to G3 of the heater array B. The decoder 1203B generates control data from the block control data, and outputs it to each heater array.

The shift register 1104C holds data input from the terminal 1106C. The data correspond to the groups G0 to G4 of the heater array C. The shift register 1104A holds data corresponding to the groups G5 to G7 of the heater array C. Thus, the driving circuit corresponding to the heater array C receives data from the latch circuits 1103A and 1103C.

In this manner, the third embodiment reduces the difference between the numbers of data bits held in a plurality of shift registers and a plurality of latch circuits. The third embodiment can efficiently lay out circuits and efficiently transfer data to each print element.

Fourth Embodiment

The fourth embodiment will be explained. A description of the same contents as those in the first, second, and third embodiments will not be repeated, and only a difference will be explained. An element substrate according to the fourth embodiment includes three heater arrays and three shift registers. The number of heaters of a heater array in which heaters are arranged at low density (300 dpi) is eight. The number of heaters of a heater array in which heaters are arranged at intermediate density (600 dpi) is 16. The number of heaters of a heater array in which heaters are arranged at high density (1,200 dpi) is 32. These heater arrays are equal in length. The time-divisional driving uses a common clock and latch signal within the element substrate.

Figure 15:
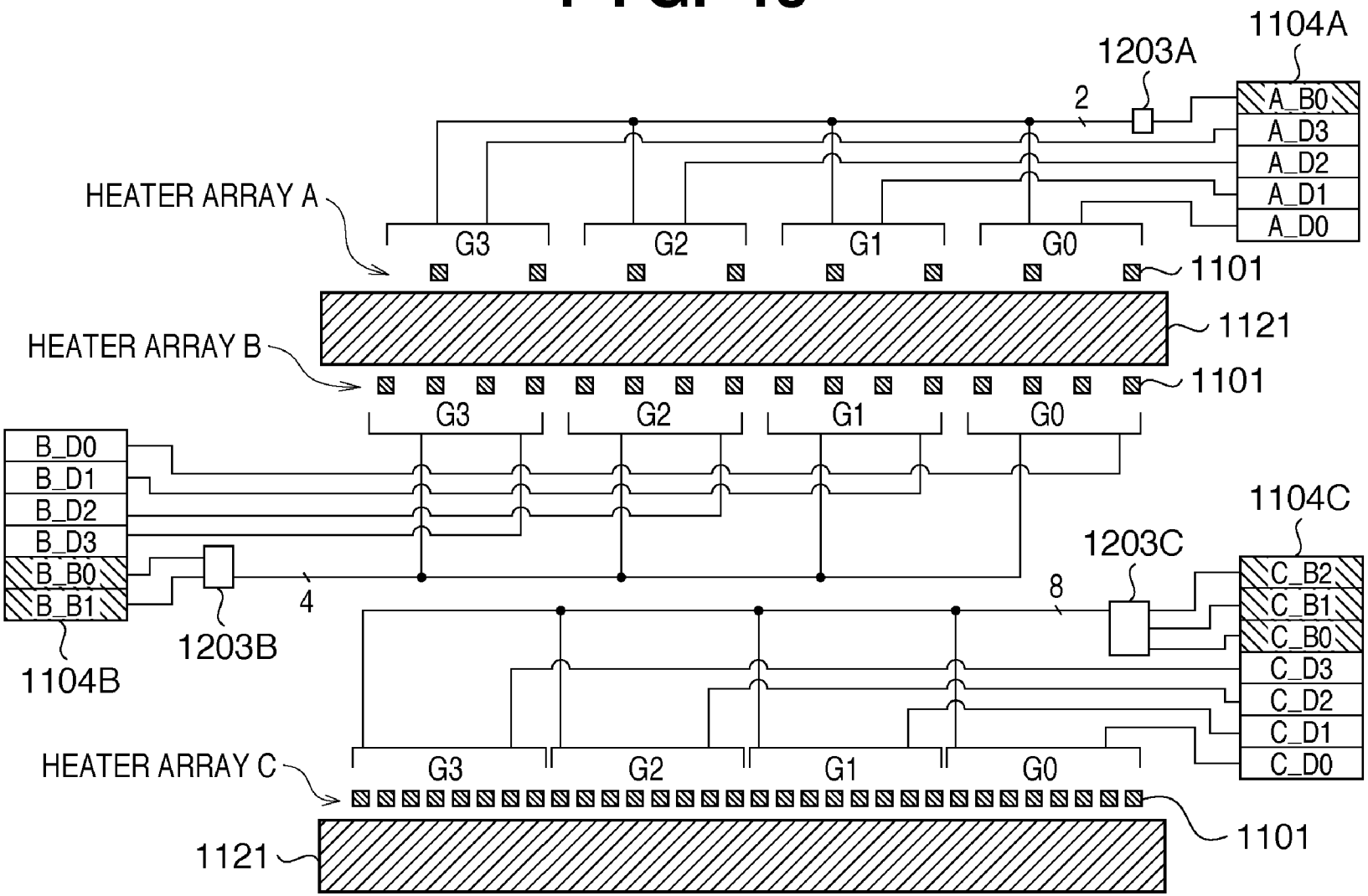
FIG. 15 is a schematic view of an element substrate for comparison with the element substrate of the fourth embodiment.

FIG. 15 is a schematic view of a conventional element substrate for comparison with the element substrate of the fourth embodiment. This element substrate includes heater arrays A, B, and C, and three shift registers 1104A, 1104B, and 1104C and three decoders 1203A, 1203B, and 1203C that correspond to the respective heater arrays. The heater array A includes four groups each made up of two adjacent heaters. Also, the heater array A includes two blocks each made up of a total of four heaters which are selected one by one from the respective groups and are driven concurrently. The heater array B includes four groups each made up of four adjacent heaters. The heater array B includes four blocks each made up of a total of four heaters which are selected one by one from the respective groups and are driven concurrently. The heater array C includes four groups each made up of eight adjacent heaters. The heater array C includes eight blocks each made up of a total of four heaters which are selected one by one from the respective groups and are driven concurrently.

In this element substrate, a driving circuit (not shown) receives a print data signal and block selection signal for each heater array. The shift register 1104A and a latch circuit (not shown) corresponding to the heater array A hold data of 5 bits. More specifically, the shift register holds print data A_D0 to A_D3 of 4 bits for the four groups, and block control data A_B0 of 1 bit for selecting a block to be driven from the two blocks. The shift register 1104B and a latch circuit (not shown) corresponding to the heater array B hold data of 6 bits. More specifically, the shift register holds print data B_D0 to B_D3 of 4 bits for the four groups, and block control data B_B0 and B_B1 of 2 bits for selecting a block to be driven from the four blocks. The shift register 1104C and a latch circuit (not shown) corresponding to the heater array C hold data of 7 bits. More specifically, the shift register holds print data C_D0 to C_D3 of 4 bits for the four groups, and block control data C_B0 to C_B2 of 3 bits for selecting a block to be driven from the eight blocks. The numbers of data bits held in the shift registers differ from each other by a maximum of 2 bits.

Figure 4:
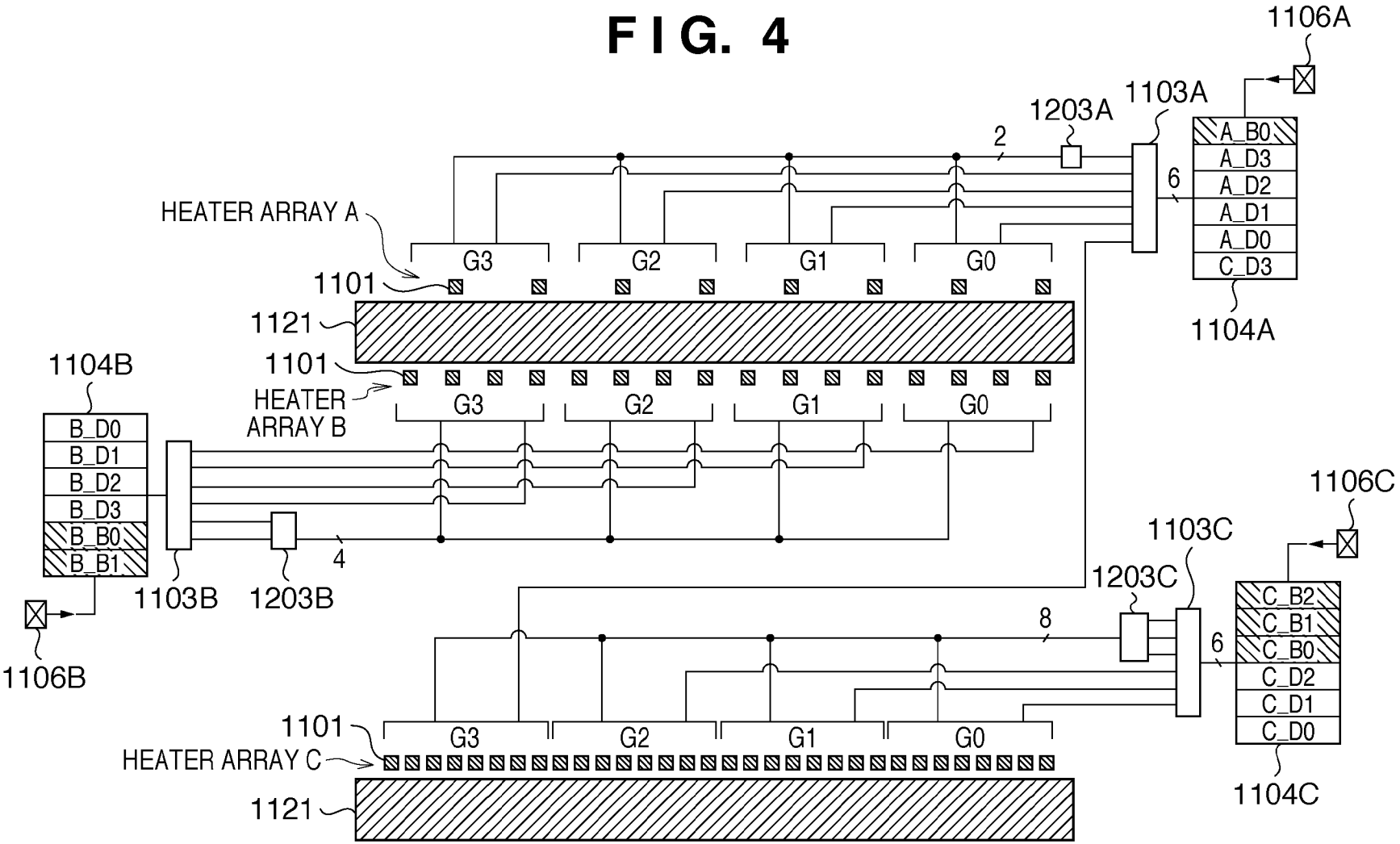
FIG. 4 is a schematic view of an element substrate according to the fourth embodiment of the present invention.

FIG. 4 is a schematic view of an element substrate according to the fourth embodiment.

The arrangements of the heater arrays A, B, and C in the element substrate of FIG. 4 are the same as those in the element substrate of FIG. 15. The arrangement of the element substrate according to the fourth embodiment is different from that of the element substrate in FIG. 15 in the following point.

In the element substrate of the fourth embodiment, the shift register 1104A holds the print data C_D3 for generating a print data signal to be supplied to the driving circuit of the heater array C. A latch circuit 1103A latches the print data C_D3 output from the shift register 1104A, and outputs it to G3 of the heater array C. This arrangement equally sets, to 6 bits, the numbers of data bits held in the three shift registers.

Note that the shift register 1104A holds the print data C_D3 in FIG. 4, but may also hold any one of the remaining print data C_D0 to C_D2. For example, when the shift register 1104A holds the print data C_D0, the latch circuit 1103A which latches the print data C_D0 suffices to output the print data C_D0 to G0 of the heater array C. Note that an inkjet printing apparatus according to this embodiment includes a data generation unit and transfer unit, similar to the third embodiment. The inkjet printing apparatus of the fourth embodiment is simply different from that of the third embodiment in the data contents and the positions of bits which form data. Thus, a description thereof will be omitted.

As described above, the fourth embodiment makes equal to each other the numbers of data bits held in a plurality of shift registers and a plurality of latch circuits. The fourth embodiment can efficiently lay out circuits and efficiently transfer data to each print element.

Other Embodiments

The above-described embodiments have exemplified an element substrate having a relatively small number of heaters.

However, the present invention is also applicable to an element substrate having a large number of heaters. The above-described embodiments have exemplified an element substrate having two or three heater arrays. However, the present invention is also applicable to an element substrate having a larger number of heater arrays.

The present invention is applicable to an element substrate having another functional element instead of a heater serving as a print element in the element substrate according to the above-described embodiments. For example, the present invention is applied to an element substrate in which a plurality of fuse ROMs are arranged within a single substrate. In this case, based on the same concept of the above-described embodiments, a shift register used in this element substrate functions as one corresponding to the arrangement of the fuse ROMs and the number of fuse ROMs. In this manner, the present invention can provide an element substrate corresponding to the number of fuse ROMs and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-122772, filed May 8, 2008, which is hereby incorporated by reference herein in its entirety.

What is claimed is:

1. A print element substrate comprising:

a first print element array and a second print element array each having a plurality of print elements;

a first driving circuit which divides the plurality of print elements included in said first print element array into a predetermined number of groups and time-divisionally drives print elements belonging to each group;

a second driving circuit which divides the plurality of print elements included in said second print element array into a larger number of groups than the predetermined number of groups, and time-divisionally drives print elements belonging to each group;

a first shift register circuit which holds data for driving the print elements belonging to said first print element array, and data for driving part of the print elements belonging to said second print element array; and a second shift register circuit which holds data for driving part of the print elements belonging to said second print element array.

2. The print element substrate according to claim 1, wherein the data held in said first shift register circuit and the data held in said second shift register circuit respectively include information for selecting a print element to be driven from the print elements belonging to the groups which respectively form said first print element array and said second print element array.

3. The print element substrate according to claim 1, wherein said first shift register circuit and said second shift register circuit are respectively connected to external input signal lines.

4. The print element substrate according to claim 1, further comprising a latch circuit which outputs, to said first driving circuit, data of a predetermined bit range out of the data held in said first shift register circuit, and outputs data other than the data of the predetermined bit range to said second driving circuit.

5. The print element substrate according to claim 1, wherein a count of time division executed by said first driving circuit is equal to a count of time division executed by said second driving circuit.

6. A printhead having a print element substrate according to claim 1.

7. A printing apparatus having a carriage capable of mounting a printhead according to claim 6.

8. The printing apparatus according to claim 7, further comprising a generation circuit which generates data to be held in the first shift register circuit and the second shift register circuit.

* * * * *